US010198022B1

(12) United States Patent
Far

(10) Patent No.: US 10,198,022 B1
(45) Date of Patent: Feb. 5, 2019

(54) ULTRA-LOW POWER BIAS CURRENT GENERATION AND UTILIZATION IN CURRENT AND VOLTAGE SOURCE AND REGULATOR DEVICES

(71) Applicant: Ali Tasdighi Far, San Jose, CA (US)

(72) Inventor: Ali Tasdighi Far, San Jose, CA (US)

( * ) Notice: Subject to any disclaimer, the term of this patent is extended or adjusted under 35 U.S.C. 154(b) by 0 days.

(21) Appl. No.: 15/925,721

(22) Filed: Mar. 19, 2018

Related U.S. Application Data

(63) Continuation of application No. 15/375,170, filed on Dec. 12, 2016, now Pat. No. 9,921,600, which is a continuation of application No. 14/795,862, filed on Jul. 9, 2015, now Pat. No. 9,519,304.

(60) Provisional application No. 62/129,002, filed on Mar. 5, 2015, provisional application No. 62/126,588, filed on Feb. 28, 2015, provisional application No. 62/060,193, filed on Oct. 6, 2014, provisional application No. 62/022,820, filed on Jul. 10, 2014.

(51) Int. Cl.
*G05F 3/26* (2006.01)

(52) U.S. Cl.
CPC ..... *G05F 3/262* (2013.01)

(58) Field of Classification Search
CPC ..... G05F 3/18; G05F 3/22; G05F 3/30; G05F 3/247; G05F 3/262; G05F 1/56; G05F 1/565; G05F 1/575; H02J 1/102; Y02B 70/1466; H02M 3/156–3/158; H02M 3/1584; H02M 3/1588
USPC ..... 323/271–273, 311–314
See application file for complete search history.

(56) References Cited

U.S. PATENT DOCUMENTS

| | | | |
|---|---|---|---|
| 4,593,208 | A | 6/1986 | Single |
| 4,677,369 | A | 6/1987 | Bowers et al. |
| 5,283,579 | A | 2/1994 | Tasdighi |
| 5,294,927 | A | 3/1994 | Levinson et al. |
| 5,640,084 | A | 6/1997 | Tero et al. |
| 5,668,710 | A | 9/1997 | Caliboso et al. |
| 5,734,260 | A | 3/1998 | Tasdighi et al. |
| 5,734,291 | A | 3/1998 | Tasdighi et al. |
| 5,734,292 | A | 3/1998 | Tasdighi et al. |
| 5,783,936 | A | 7/1998 | Girard et al. |
| 5,814,995 | A | 9/1998 | Tasdighi |
| 5,923,208 | A | 7/1999 | Tasdighi et al. |
| 5,949,278 | A | 9/1999 | Oguey |
| 6,005,374 | A | 12/1999 | Tasdighi |
| 6,054,823 | A | 4/2000 | Collings et al. |

(Continued)

OTHER PUBLICATIONS

Samsen, Willy M., "A CMOS Temperature-Compensation Current Reference", IEEE Journal of Solid-State Circuits, Jun. 1988,p. 821, vol. 23.

(Continued)

*Primary Examiner* — Yemane Mehari
(74) *Attorney, Agent, or Firm* — Roark IP

(57) ABSTRACT

A bias current topology with embodiments in current source, current reference, (pseudo bandgap) voltage reference, and bandgap voltage reference that operate at ultra low currents and low power supply voltages which may use main stream standard digital Complementary Metal-Oxide-Semiconductor (CMOS) processes. The bias current topology uses chiefly a self cascode (SC), whose active resistor MOSFET is paced in series with the gate input of the MOSFETs that help generate the proportional to absolute temperature (PTAT) voltage that is applied to the active resistor MOSFET to produce a bias current.

2 Claims, 9 Drawing Sheets

(56) References Cited

U.S. PATENT DOCUMENTS

| | | | | |
|---|---|---|---|---|
| 6,107,868 | A | 8/2000 | Diniz et al. | |
| 6,122,284 | A | 9/2000 | Tasdighi et al. | |
| 6,281,743 | B1 | 8/2001 | Doyle | |
| 6,366,071 | B1 | 4/2002 | Yu | |
| 6,489,831 | B1 | 12/2002 | Matranga et al. | |
| 6,657,480 | B2 | 12/2003 | Ochi | |
| 6,885,178 | B2 | 4/2005 | Marinca | |
| 7,211,993 | B2 | 5/2007 | Marinca | |
| 7,612,606 | B2 | 11/2009 | Marinca | |
| 7,994,848 | B2 * | 8/2011 | Kothandaraman | G05F 3/30 327/539 |
| 9,519,304 | B1 * | 12/2016 | Far | G05F 3/262 |
| 9,780,652 | B1 | 10/2017 | Far | |
| 9,921,600 | B1 | 3/2018 | Far | |
| 2002/0093325 | A1 | 7/2002 | Ju | |
| 2004/0056708 | A1 | 3/2004 | Bedarida et al. | |
| 2004/0124822 | A1 | 7/2004 | Marinca | |
| 2005/0264345 | A1 | 12/2005 | Ker et al. | |
| 2005/0285666 | A1 | 12/2005 | Garlapati et al. | |
| 2007/0052473 | A1 | 3/2007 | McLeod | |
| 2007/0076483 | A1 | 4/2007 | Colman | |
| 2007/0132506 | A1 | 6/2007 | Fujisawa et al. | |
| 2008/0018316 | A1 | 1/2008 | Chang et al. | |
| 2008/0224682 | A1 | 9/2008 | Haiplik | |
| 2008/0278137 | A1 | 11/2008 | Harvey | |
| 2009/0243711 | A1 * | 10/2009 | Marinca | G05F 3/30 327/541 |
| 2010/0068767 | A1 | 3/2010 | Bishop et al. | |
| 2010/0164467 | A1 | 7/2010 | Jo | |
| 2010/0225384 | A1 | 9/2010 | Hirose et al. | |
| 2010/0237926 | A1 | 9/2010 | Kikuta et al. | |
| 2011/0025666 | A1 | 2/2011 | Baek et al. | |
| 2011/0068767 | A1 | 3/2011 | Carper | |
| 2011/0102049 | A1 | 5/2011 | Conte et al. | |
| 2012/0176186 | A1 | 7/2012 | Chen et al. | |
| 2012/0323508 | A1 * | 12/2012 | Vilas Boas | G01R 19/32 702/60 |
| 2015/0160680 | A1 | 6/2015 | Marinca | |

OTHER PUBLICATIONS

De La Plaza, Alejandro, "Nanoamperer Supply Independent Low-Voltage Current Reference", Faible Tension Faible Communication, May 2011, p. 9.

Fayomi, Christian, "Sub 1V CMOS bandage reference design techniques a survye", Analog Integrated Cir Sig Process, Feb. 2010, p. 141.

Vittoz, Eric, "A low-Voltage CMOS Bandgap Reference", IEEE Journal of Solid-State Cirucuits, Jun. 1979, vol. SC-14, No. 3, Feb. 2010, p. 141.

Galeano, Edgar, "A Very Low Power Area Efficient CMOS Only Bandgap Reference", Integrated Circuits and Sys Design, Aug. 2012, p. 1.

Osaki, Yuji, "A 95-nA, 523 ppm/C, .6-uW CMOS Current Reference Circuits w/ Subthreshold MOS Resistor Ladder", ASPDAC '11, Jan. 2011, p. 113.

Ueno, Ken, "A 1-uW 600-ppm/C Current Ref Circuits Consiting of Subthreshold CMOS Circuits", IEEE Transactio on Circits, Sep. 2010, p. 681.

De Vita, "A 109 nW, 44 ppm/C CMOS Current Reference with Low Sensitivity to Process Variations", Curcuits and Systems, Feb. 2007, p. 3804.

Ledesma, F., "Comparison of New and Conventional Low Voltage Current Mirrors", Circuits and Systems, Aug. 2003, p. 49-52.

Hirose, Tetsuya, "A Nano-Ampere Current Regerence Circuits and Its Temperature Dependence," Proceedings of the EECIRC,Oct. 2010, p. 114.

Camarcho-Galeano, Edgar, "A 2-nW 1.1V Self-Based Current Reference in CMOS Technology", On Circuits and System, Feb. 2005,p. 62.

Camarcho-Galeano, Edgar, "Temperature Performance of Sub-1V Ultra-Low Power Current Sources", Circuits and Systems,May 2008, p. 2230.

Osaki, "Nano-Ampere CMOS Current Reference with Little Temp. Dependence Using Small Offset Voltage", Proc. at 53rd IEEE Intl, Aug. 2010, p. 668.

Gallegos, S., "A 128.7nW Neural Amplifier and Gm-C Filter for EEG, Using gm/ID Methodology . . . ", Circuits and Systems, Aug. 2014, p. 876.

Cordova, David, "A Low-Voltage Current Reference with High Immunity to EMI", Integrated Circuits and Systems Design, Sep. 2014, p. 1-6.

Annema, Anne-Johan, "Low-Power Bandgap References Featuring DTMOST's", IEEE Journal of Solid-State Circuits, Jul. 1999, p. 949.

Buck, Ame, "A CMOS Bandgap Regerence without Resistors", Solid-State Circuits Conference, Dec. 2000, p. 442-443.

Chouhan, Shailesh, "A modified CMOS Nano-Power Resistorless Current Reference Circuits",Microelectronics and Electronics,Jun. 2014, p. 1.

Guiges, Fabrice, "Sub-1V Oguey's Current Reference Without Resistance", Circuits and Systems, Dec. 2006, pp. 288-291.

Guistolisi,G., "Low-Voltage Low Power Voltage Reference Based on Subthreshold MOSFETS", Journal of Solid-State Circuits,Jan. 2003, p. 151.

Hirose, T., "A CMOS Bandgap and Sub-Bandgap Voltage Reference Circuits for Nanowatt Power LSIs", IEEE Asian Solid-State,Nov. 2010, p. 77.

Kussener, F, "50 nA, 1V Nanowatt Resistor-Free Compact CMOS Current Reference", Electronics, Circuits and Systems,Dec. 2010, p. 1212.

Oguey, H., "CMOS Current Reference Without Reference", IEEE Journal of Solid-State Circuits, Jul. 1997, p. 1132, vol. 32.

Serra-Graelis, F., "Sub-1V CMOS Porportional-to-Absolute Temp. References"Journal of Solid-State Circuits, Jan. 2003, p. 84.

Ueno,Ken,"A 300 nW,15 ppm/C,20 ppm/V CMOS Voltage Ref Circuit . . . ", Journal of Solid-State Circuits, Jun. 2009, p. 2097.

VanPetegham, Peter, "On a New CMOS Resistor Implementation for Linear Anlog IC Signal Processing Application," IEEE, Jun. 1998, p. 163-166.

Vittoz, Eric, "CMOS Analog ICs Based on Weak Inversion Operation", Journal of Solid-State Circuits, Jun. 1977, p. 224.

Wilson,G., "Novel Voltage-Controlled Grounded Resistor", Electronic Letters, Dec. 1989, pp. 1725-1726.

Huang, Zhangcai, "A CMOS Sub-1-V Nanopower Current and Voltage Ref with Leakage Compensation", Circuits and Systems,Jul. 2010, p. 4069.

Colombo, Dalton, "A CMOS 25.3 ppm/C Bandgap Voltage Ref using Self-Cascode Composite Transistor", Circuits and Systems,Apr. 2012, p. 1.

Colombo, Dalton. "A CMOS 25.3 ppm/C Bandgap voltage Reterence Using Self-Cascade Composite Transistor", Circuits and Systems, 2012.

A. Far, "Small size class AB amplifier for energy harvesting with ultra low power, high gain, and high CMRR," 2016 IEEE International Autumn Meeting on Power, Electronics and Computing (ROPEC), Ixtapa, 2016. pp. 1-5.

A. Far, "Compact ultra low power class AB buffer amplifier," 2017 IEEE International Autumn Meeting on Power, Electronics and Computing (ROPEC), Ixtapa, 2017, pp. 1-6.

A. Far, "Subthreshold curent reference suitable for energy harvesting: 20ppm/C and 0.1%/V at 140nW," 2015 IEEE International Autumn Meeting on Power, Electronics and Computing (ROPEC), Ixtapa, 2015, pp. 1-4.

A. Far, "Amplifier for energy harvesting: Low voltage, ultra low current, rail-for-rail input-output, high speed," 2016 IEEE International Autumn Meeting on Power, Electronics and Computing (ROPEC), Ixtapa, 2016, pp. 1-6.

A. Far, "Class AB amplifier with noise reduction, speed boost, gain enhancement, and ultra low power," 2018 IEEE 9th Latin American Symposium on Circuits & Systems (LASCAS), Puerto Vallarta, Mexico, 2018, pp. 1-4.

(56) References Cited

OTHER PUBLICATIONS

A. Far, "Low noise rail-to-rail amplifier runs fast at ultra low currents and targets energy harvesting," 2017 IEEE International Autumn Meeting on Power, Electronics and Computing (ROPEC), Ixtapa, 2017, pp. 1-6.
A. Far, "A 5μW fractional CMOS bandgap voltage and current reference," 2013 IEEE Global High Tech Congress on Electroics, Shenzhen, 2013, pp. 7-11.
A. Far, "A 400nW CMOS bandgap voltage reference," 2013 International Conference on Electrical, Electronics and System Engineering (ICEESE), Kuala Lumpur, 2013, pp. 15-20.
A. Far, "Enhanced gain, low voltage, rail-to-rail buffer amplifier suitable for energy harvesting," 2017 IEEE International Autumn Meeting on Power, Electronics and Computing (ROPEC), Ixpata, 2017, pp. 1-6.
A. Far. "Subthreshold bandgap voltage reference aiming for energy harvesting: 100na, 5 ppm/c, 40 ppm/v, psrr-88db," 2015 IEEE 5th International Conference on Consumer Electronics—Berlin (ICCE—Berlin), Berlin, 2015, pp. 310-313.
A. Far, "A 220nA bandgap reference with 80dB PSRR targeting energy harvesting," 2016 IEEE Canadian Conference on Electrical and Computer Engineering (CCECE), Vancouver, BC, 2016, pp. 1-4.
A. Far, "Sub-1 volt class AB amplifier with low noise, ultra low power, high-speed, using winner-take-all," 2018 IEEE 9th Latin American Symposium on Circuites & Systems (LASCAS), Puerto Vallarta, Mexico, 2018, pp. 1-4.
A. Far, "A low supply voltage 2μW half bandgap reference in standared sub-μ CMOS," 2014 IEEE International Conference on Electronics, Computing and Communication Technologies (CONECCT), Bangalore, 2014, pp. 1-5.
A. Far, "Current reference for energy havrvesting: 50um per side, At 70nW, regulating to 125C," 2014 IEEE International Autumn Meeting on Power, Electronics and Computing (ROPEC), Ixtapa, 2014, pp. 1-5.
J. Mu, L. Liu, Z. Zhu and Y. Yang, "A 58-ppm/° C. 40-nW BGR at Supply From 0.5 V from Energy Harvesting IoT Devices," In IEEE Tranactions on Circuits and Systems II: Express Briefs, vol. 64, No. 7, pp. 752-756, Jul. 2017, doi: 10.1109/TCSII.2016.2602875.
Z. Zhou et al., "A Resistorless High-Precision Compensated CMOS Bandgap Voltage Regerence," in IEEE Transactions on Circuits and Systems I: Regular Papers. doi: 10.1109/TCSI.2018.2857821.
J. Chen, X. Ni, B. Mo and Z. Wang, "A High Precision Curvature Compensated Bandgap Reference without Resistors," 2006 8th International Conference on Solid-State and Integrated Circuit Technology Proceedings, Shanghai, 2006, pp. 1748-1750, doi: 10.1109/ICSICT.2006.306414.
V. R. Campana, H. Klimach and S. Bampi, "Nano-watt 0.3 V supply resistorless voltage reference with Schottky diode," 2016 IEEE 7th Latin American Symposium on Circuits & Systems (LASCAS), Florianopolis, 2016, pp. 175-178. doi: 10.1109/LASCAS.2016.7451038.
H. Klimach, M. F. C. Monteiro, A. L. T. Costa and S. Bampi, "A resistorless switched bandgap reference topology," 2013 IEEE 4th Latin American Symposium on Circuits and Systems (LASCAS), Cusco, 2013, pp. 1-4. doi: 10.1109/LASCAS.2013.6519026.
V. R. Campana, H. Klimach and S. Bampi, "Nano-watt 0.3 V supply resistorless voltage reference with Schottky diode." 2016 IEEE 7th Latin American Symposium on Circuits & Systems (LASCAS), Florianopoils, 2016, pp. 175-178. doi: 10.1109/LASCAS.2016.7451038.
V. R. Campana, H. Klimach and S. Bampi, "0.5 V supply resistorless voltage reference for low voltage applications," 2015 28th Symposium on Integrated Circuits and Systems Design (SBCCI), Salvador, 2015, pp. 1-6.
W. Tam, K. Mok, O. Wong, C. Kok and H. Wong, "High-Performance Resistorless Sub-1V Bandgap Reference Circuit Based on Piecewise Compensation Technique," 2007 IEEE Conference on Electron Devices and Solid-State Cirucuits, Tainan, 2007, pp. 373-376. doi: 10.1109/EDSSC.2007.4450140.
O. E. Mattia, H. Kilmach and S. Bampi, "0.9 V, 5nW. 9 ppm/oC resistorless sub-bandgap voltage reference in 0.18μm CMOS," 2014 IEEE 5th Latin American Symposium on Circuits and Systems, Santiago, 2014, pp. 1-4. DOI: 10.1109/LASCAS.2014.6820273.
A. Tekin, E. Zencir, D. Huang, N. S. Dogan, M. Katel, and E. Arvas, "A bias circuit based on resistorless bandgap reference in 035 spl mu/m SOI CMOS," 2003 46th Midwest Symposium on Circuits and Systems, Cairo, 2003, pp. 149-152 vol. 1. doi: 10.119/MWSCAS.2003.1562240.
O. E. Mattia, H. Klimach and S. Bampi, "Resistorless BJT bias and curvature compensation circuit at 3.4 nW for CMOS bandgap voltage reference," in Electronics Letters, vol. 50, No. 12, pp. 863-864, Jun. 5, 2014. doi: 10.1049/el.2013.3417.
I. Fakharyan and M. Ehsanian, "A sub-1V nanowatt CMOS bandgap voltage reference with temperature coefficient of 13ppm/° C.," 2015 23rd Iranian Conference on Electrical Engineering, Tehran, 2015, pp. 1129-1132. doi: 10.1109/IranianCEE.2015.7146382.
D. M. Colombo, T. M. de Brito and F. V. A. Coimbra, "An approach a new 1 V supply resistorless voltage reference using Schottky diode," 2018 IEEE 9th Latin American Symposium on Circuits & Systems (LASCAS), Puerto Vallarta, 2018, pp. 1-4. doi: 10.1109/LASCAS.2018.8399955.
F. Dumitru, Ş. Mihalache and G. Brezeanu, "A CMOS resistorless bandgap reference with minimized current consumption," 2015 International Semiconductor Conference (CAS), Sinata, 2015, pp. 289-292, doi: 10.1109/SMICND.2015.7355235.
K. Jaafar, N. Kamal, M. Bin Ibne Reaz and J. Sampe, "Resistorless self-biased curvature compensated sub-1V CMOS bandgap reference," 2016 International Conference on Advances in Electrical Electronic and Systems Engineering (ICAEES), Putrajaya, 2016, pp. 309-312. doi: 10.1109/ICAEES.2016.7888059.
Z. Zhao, S. Huang and F. Zhou, "A novel CMOS current reference with low temperature coefficient over a large temperature range," 2010 10th IEEE International Conference on Solid-State and Integrated Circuit Technology, Shanghai, 2010, pp. 415-417. doi: 10.1109/ICSICT.2010.5667695.
W. Yang, Z. Huang, C. Cheng and Y. Lo, "Temperature insensitive current reference for the 6.27 MHz oscillator," 2011 International Symposium on Integrated Circuits, Singapore, 2011, pp. 559-562. doi: 10.1109/ISICir.2011.6131924.
B. Yang, Y. Shin, J. Lee, Y. Lee and K. Ryu, "An accurate current reference using temperature and process compensation current mirror," 2009 IEEE Asian Solid-State Circuits Conference, Taipei, 2009, pp. 241-244. doi: 10.1109/ASSCC.2009.5357223.
S. Toofan and A. Tajari, "A temperature-compensated current source with high output impedance," 20th Iranian Conference on Electrical Engineering (ICEE2012), Tehran, 2012, pp. 109-112. doi: 10.1109/IranianCEE.2012.6292334.
Y. Osaki, T. Hirose, N. Kuroki and M. Numa, "Nano-ampere CMOS current reference with little temperature dependence using small offset voltage," 2010 53rd IEEE International Midwest Symposium on Circuits and Systems, Seattle, WA, 2010, pp. 668-671. doi: 10.1109/MWSCAS.2010.5548916.
T. Nagayama, T. Hirose, Y. Osaki, N. Kuroki nand M. Numa, "A 105-nW CMOS thermal sensor for power-aware applications," SENSORS, 2011 IEEE, Limerick, 2011, pp. 1265-1268. doi: 10.1109/ICSENS.2011.6127039.
C.-Lee adn H.-Park, "All-CMOS temperature independent current reference," in Elecronics Letters, vol. 32, No. 14, pp. 1280-1281, Jul. 4, 1996, doi: 10.1049/el.19960827.
G. De Vita and G. Iannaccone, "A 109 nW, 44 ppm/° C CMOS Current Reference with Low Sensitivity to Process Variations," 2007 IEEE International Symposium on Circuits and Systems, New Orleans, LA, 2007, pp. 3804-3807. doi: 10.1109/ISCAS.2007.378790.
U. Denier, "Analysis and Design of an Ultralow-Power CMOS Relaxation Oscillator," in IEEE Tranactions on Circuits and Systems I: Regular Papers, vol. 57, No. 8, pp. 1973-1982. Aug. 2010, doi: 10.1109/TCSI.2010.2041504.
D. Cordova, P. Toledo and E. Fabris, "A low-voltage current reference with hgih immunity to EMI," 2014 27th Symposium on Integrated Circuits and Systems Design (SBCCI), Aracaju, 2014, pp. 1-6. doi: 10.1145/2660540.2660989.

(56) References Cited

OTHER PUBLICATIONS

G. Chen, B. Yang, S. Nakatake, Z. Huang and Y. Inoue, "A retargeting methodology of nano-watt CMOS reference circuit based on advanced compact MOSFET model," IEEE International Symposium on Circuits and Systems, Seoul, 2012, pp. 938-941. doi: 10.1109/ISCAS.2012.6272199.

S. S. Bethi, K. Lee, R. Veilletle, J. Carletta and M. Willett, "A temperature and process insensitive CMOS reference current generator," 2013 IEEE 56th International Midwest Symposium on Circuits and Systems (MWSCAS), Columbus, OH, 2013, pp. 301-304. doi: 10.1109/MWSCAS.2013.6574645.

C. Aznona, B. Calvo, S. Celma, N. Medrano and M. T. Sanz, "Precision CMOS current reference with process and temperature compensation," 2014 IEEE International Symposium on Circuits and Systems (ISCAS), Melbourne VIC, 2014, pp. 910-913 doi: 10.1109/ISCAS.2014.8665284.

P. Vajpayee, A. Srivastava, S. S. Rajput and G. K. Sharma, "Low voltage regulated cascade current mirrors suitable for sub-1V operation," 2010 IEEE Asia Pacific Conference on Circuits and Systems, Kuala Lumpur, 2010, pp. 584-587. doi: 10.1109/APCCAS.2010.5774891.

D. Schmitt and T. S. Fiez, "A low voltage CMOS current source," Proceedings of 1997 International Symposium on Low Power Electronics and Design, Monterey, CA, USA, 1997, pp. 110-113. doi: 10.1145/263272.263301.

Fayomi, C.J., "Sub 1 V CMOS bandgap reference design techniques: a survey." Journal Analog Integrated Circuits and Signal Processing archive, vol. 82, Issue 2, pp. 141-157, Feb. 2010. DOI: 10.1007/s10470-009-9352-4.

Kussener, E. at al "50 nA, 1 V nanowatt resistor-free compact CMOS current references," Electronics Circuits, and Systems (ICECS), 2010 17th IEEE International Conference on, vol., No., pp. 1212,1215, Dec. 12-15, 2010, DOI: 10.1109/ICECS.2010.5724736.

E. M. Camacho-Galeano, C. Galup-Montoro end M. C. Schneider, "A 2-nW 1.1-V self-biased current reference in CMOS technology," in IEEE Transactions on Circuits and Systems II: Express Briefs, vol. 52, No. 2, pp. 61-65, Feb. 2005. doi: 10.1109/TCSII.2004.842059.

K. Ueno, T. Hirose, T. Asai and Y. Amemiya, "A Current Reference Circuit Consisting of Subthreshold CMOS Circuits," in IEEE Transactions on Circuits and Systems II: Express Briefs, vol. 57, No. 9, pp. 681-685, Sep. 2010. doi: 10.1109/TCSII.2010.2056051.

H. J. Oguey and D. Aebischer, "CMOS current reference without resistance " in IEEE Journal of Solld-Stale Circuits, vol. 32, No. 7, pp. 1132-1135, Jul. 1997. doi: 10.1109/4.597305.

Serra-Graells, F. et al, "Sub-1-V CMOS proportional-to-absolute temperature references," Solid-State Circuits, IEEE Journal of , vol. 38, No. 1, pp. 84,88, Jan. 2003 doi: 10.1109/JSSC.2002.806258.

* cited by examiner

ULTRA-LOW POWER BIAS CURRENT GENERATION AND UTILIZATION IN CURRENT AND VOLTAGE SOURCE AND REGULATOR DEVICES

CROSS-REFERENCE TO RELATED PATENT APPLICATIONS

This application claims the priority benefit of Ser. No. 15/375,170, filed on Dec. 12, 2016; which claims the priority benefit of U.S. patent application Ser. No. 14/795,862, filed on Jul. 9, 2015; which claims priority benefit of U.S. Provisional Patent Application Ser. No. 62/022,820, filed Jul. 10, 2014 and entitled "An Ultra Low Power CMOS Current Source"; U.S. Provisional Patent Application Ser. No. 62/060,193 filed Oct. 6, 2014 and entitled "A Very Low Power Resistorless CMOS Bandgap Voltage Reference"; U.S. Provisional Patent Application Ser. No. 62/126,588 filed Feb. 28, 2015 and entitled "A Very Low Power and Stable Current Reference"; and U.S. Provisional Patent Application Ser. No. 62/129,002 filed Mar. 5, 2015 and entitled "A CMOS Bandgap Reference With Improved PSRR and Voltage Coefficient". Each of the above applications are herein specifically incorporated by reference in their entirety.

FIELD OF THE INVENTION

This invention relates to improvements in bias current generation for use in analog and mixed signal integrated circuits (ICs), such as current and voltage references and others.

BACKGROUND

Bias current generation is a core requirement for any integrated circuits (IC), including for higher order functions such as references, regulators, amplifiers, filters, clocks, analog to digital converter (ADC), digital to analog converter (DAC) and other key building blocks in any analog, mixed mode electronic system, or system on a chip (SOC). The bias current should be relatively stable under varying power supply and temperature conditions. Ideally it may further have the capability to operate with low power consumption.

SUMMARY OF THE INVENTION

Aspects of the embodiments disclosed herein include that they can often be fabricated in standard digital complementary metal-oxide semiconductor (CMOS) (e.g., for low cost and high volume applications); they may be resistor less (for ultra low power battery powered and emerging batteryless applications, and small size applications); their performance is Mostly independent of metal-oxide-semiconductor field effect transistor's (MOSFET's) threshold voltage or $V_{TH}$ (e.g., for tight performance despite wide manufacturing variations of $V_{TH}$); and the embodiments typically operate MOSFETs in subthreshold (e.g., for low current and low supply voltage consumption applications). Also, by scaling and operating MOSFET pairs in the subthreshold region a pseudo thermal voltage or $V_T$ may be generated which has proportional to absolute temperature (PTAT) voltage characteristics.

Other aspects of the embodiments disclosed herein may be a 'current source' comprising: a self cascode (SC) and an amplification function (in conjunction with PTAT voltage generation) whereby the PTAT signal is generated which is mostly dependent on thermal voltage ($V_T$). Also, a complementary to absolute temperature (CTAT) signal is generated which is mostly dependent on MOSFET's mobility (μ) so that a relatively temperature and $V_{TH}$ independent bias current ($I_{BIAS}$) source may be produced. This may be done in part by applying the PTAT voltage ($V_{PTAT}$) and supplying the $I_{BIAS}$) at the gate and not the source of the reference current mirror or loop amplifier. In this way, the active MOS resistor (and the generation of the $V_{PTAT}$) is effectively placed in series with the gate terminals (instead of the source terminal) of the current mirror or loop amplifier. This topology provides the option and flexibility for employing differential source followers (or differential voltage followers) in unity gain before the amplification function. This option can help in generating a higher amplitude $V_{PTAT}$ so to improve performance and die yield. The temperature coefficient (TC) of the current source can receive adjustments (through program or predetermination by topology with different MOSFET's aspect ratios) to exhibit approximately flat or positive or negative TC depending on electronics system's requirements.

Other aspects of the embodiments disclosed herein are a method of creating a 'current reference': two bias current sources (with same functional topology as the first disclosure above) $I_{TCa}$ and $I_{TCb}$ with same polarity TCs that are set by W/L ratios to yield differing slopes, and subsequently be ratioed and subtracted from each other to form a stable TC current reference ($I_{REF}$). Alternatively, depending on an application, the topology has the flexibility to deliver positive TC or negative TC $I_{REF}$ that can also receive adjustments by programming or setting different MOSFET W/Ls. In each of the two bias current sources, the amplifier's built-in offsets are forced across MOSFETs contained in self-cascodes (SC) to make the $I_{TCa}$ and $I_{TCb}$. The magnitudes of $I_{TCa}$ and $I_{TCb}$ are set partially independently from their TCs via MOSFET's aspect ratios. To generate an $I_{REF}$ with stable TC, a current scalar and subtraction circuit then scales $I_{TCa}$ to $S_a.I_{TCa}$ whose value changes by the same amount as $S_b$. $I_{TCb}$ over an objective temperature span. This resultant $S_a.I_{TCa}$ current is then subtracted from $S_b.I_{TCb}$ to yield an $I_{REF}$. $S_a$ and $S_b$ are abbreviated formulaic representations (as a function of MOSFET W/L ratios and CMOS device constants).

Other aspects of the embodiments disclosed herein are a 'voltage reference' ($V_{REF}$) circuit comprising: resistor free voltage reference with an output voltage $V_{REF}$, which can be a pseudo bandgap voltage, $V_{BG}$. Here, CTAT signal voltage ($V_{CTAT}$) is generated by $V_{BE}$ of a parasitic bipolar junction transistor (BJT) in CMOS, and its PTAT signal voltage $V_{PTAT}$ is generated by summing K of pseudo thermal voltage, $V_T \times \ln(g)$, terms generated via K series (or chain) of scaled p-channel MOSFET (PMOSFET) self-cascodes (SC), whose operating conditions are provided through a bias current generator with substantially similar functional block diagram as the first and second disclosures above. Similarly, the TC of this $V_{REF}$ can be set (by programming or predetermination by topology with different MOSFET's aspect ratios) to exhibit approximately flat or positive or negative TC, depending on electronics system's need.

Other aspects of the embodiments disclosed herein include a method of generating a bandgap voltage reference, $V_{BG}$. In the general category of conventional bandgaps, a voltage reference is comprised of a $V_{PTAT}$ that is gained up by the ratios of two passive resistors and then added to a $V_{CTAT}$ (e.g., $V_{BE}$) to produce $V_{BG}$. Passive resistors are generally prohibitive, in size or cost, for ultra low power applications based in standard digital CMOS. This embodiments herein generally eliminate the need for passive resistors. Instead, this disclosure consists of a network of composite active MOS resistors whose operating conditions (e.g., current) are supplied via the substantially similar bias current functional topology. Here, the central bias current generation and the bandgap loop circuitries, independently apply $V_{PTAT}$ across functionally similar composite MOS resistors (i.e., $R_{M802}$ and $R_{M826r}$) to generate their respective operating currents (i.e., as a multiple or ratio of $I_{bias}$). The resultant $V_{PTAT}$ is subsequently added to a $V_{CTAT}$ (e.g., $V_{EB}$) to generate a $V_{BG}$. Again, the TC of this reference can be set (via programming or predetermination by topology with different MOSFET's aspect ratios) to exhibit approximately flat (for $V_{BG}$) or positive or negative TC output $V_{REF}$, depending on electronics system's requirement. Note that operations of: $R_{BIAS}$ and $I_{BIAS}$ in the SC of the bias generation circuit, the composite active MOS resistor circuit (i.e., $R_{BS}$), the chain or series of the same composite active MOS resistor (i.e., p.$R_{BG}$), and the bandgap's PTAT loop follow substantially similar operating mechanisms over process, temperature, and power supply variations. This embodiment which combines the bias current circuit, active resistor circuit, and bandgap PTAT loop circuit not only may avoid passive resistors (for ultra low current and low cost), but also it can enhance bandgap's overall performance by enabling tracking of operating conditions over process, temperature, and supply voltage variations.

Further aspects of the embodiments disclosed herein include: a method of generating a bias current by using a first active resistor metal-oxide-semiconductor field effect transistor (MOSFET) operating in the linear region that is in series with gate input terminals of a proportional to absolute temperature (PTAT) voltage generator.

Further aspects of the embodiments disclosed herein include: a system comprising: a means for generating a bias current is in series with gate input terminals of a proportional to absolute temperature (PTAT) voltage generator.

Further aspects of the embodiments disclosed herein include: a bias current generator system comprising: a first current generator comprising: a first amplifier having a built in offset voltage tracking a proportional to first absolute temperature (PTAT) voltage ($V_{PTAT}$); a first bias resistor metal-oxide-semiconductor field effect transistor (MOSFET) operating in the linear region and forming a first bias resistor, wherein the gate input terminals of the amplifier carrying the $V_{PTAT}$ are in series with source-drain terminals of the first bias resistor MOSFET; and wherein a first bias current is generated as a ratio of the first $V_{PTAT}$ over the resistance of the first bias resistor MOSFET and where adjustments can be made to the amplitude and temperature coefficient (TC) of the first bias current.

Further aspects of the embodiments disclosed herein include: a bias current generator system comprising: a MOSFET resistor operating in the linear region which is in series with a $V_{PTAT}$; and a means for generating said $V_{PTAT}$ voltage and a bias current by feeding back the bias current into the MOSFET resistor. The MOSFET resistor may be part of MOSFET self-cascode or a current mirror.

Further aspects of the embodiments disclosed herein include: a bias current generator system comprising: a first current generator comprising: a first amplifier having inputs connected to the output of a first differential voltage follower, wherein the first differential voltage follower has a built in offset voltage tracking a proportional to first absolute temperature (PTAT) voltage ($V_{PTAT}$); a first bias resistor metal-oxide-semiconductor field effect transistor (MOSFET) operating in the linear region and forming a first bias resistor, wherein the gate input terminals of the first differential voltage follower carrying the $V_{PTAT}$ are in series with source-drain terminals of the first bias resistor MOSFET; wherein the first amplifier output generates the bias current which flows through the source-drain of the bias resistor MOSFET until the amplifier input voltages are substantially equalized; and wherein a first bias current is generated as a ratio of the first $V_{PTAT}$ over the resistance of the first bias resistor MOSFET and where adjustments can be made to the amplitude and temperature coefficient (TC) of the first bias current.

Further aspects of the embodiments disclosed herein include: a bias current generator system comprising: a MOSFET resistor operating in the linear region which is in series with a $V_{PTAT}$; a means for generating a $V_{PTAT}$; and a means for generating a bias current by feeding back the bias current into the MOSFET resistor. The MOSFET resistor may be part of MOSFET self-cascode or a current mirror.

Further aspects of the embodiments disclosed herein include: a method of generating a reference current comprising: generating first and second bias currents such that the first and second bias currents have the same polarity of temperature coefficient (TC) and different TC slopes; and wherein the first and second bias currents are then scaled and subtracted from one another to yield stable TC reference current over an objective temperature range.

Further aspects of the embodiments disclosed herein include: a system of generating a reference current comprising: a MOSFET resistor operating in the linear region; and a means for generating two bias currents with the same temperature coefficients (TC) polarity but different TC slope and different amplitudes which are subsequently subtracted from one another to form the reference current.

Further aspects of the embodiments disclosed herein include: a method of using a composite active metal-oxide-semiconductor field effect transistor (MOSFET) resistors in bandgap voltage reference comprising: developing a proportional to absolute temperature voltage ($V_{PTAT}$) across a composite active MOSFET resistors and subsequently adding the $V_{PTAT}$ to a complementary to absolute temperature voltage ($V_{CTAT}$) to generate the band gap voltage.

Further aspects of the embodiments disclosed herein include: a system comprising: an active MOSFET resistor which has a $V_{PTAT}$ placed across it to generate a bias current; and a means for generating a floating resistance.

DETAILED DESCRIPTION

Figure 1:
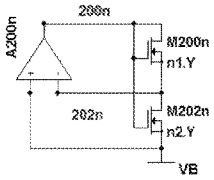
FIG. 1 is a functional block diagram of a system and method of generating 'bias current'.

The following description has been presented for purposes of illustration and description and is not intended to be exhaustive or to limit the embodiments to the precise form disclosed. Many modifications and variations are possible in light of the teachings disclosed herein. The embodiments were chosen and described to explain principles of operation and their practical applications. However, the scope of the invention is to be defined by the claims.

Battery operated or batteryless electronic systems benefit from integrated circuits and electronic components that consume minimal power, which can withstand and perform to specifications down to the lowest power supply levels over a wide span of temperatures, as well as ones that can provide stable Alternating Current (AC) and non-jittery transient power up and power down characteristics. For higher order analog functions (e.g., references, regulators, amplifiers, converters, voltage controlled oscillators, phased locked loops, clock chips, etc) and systems (e.g., mixed mode system on a chip (SOC)), higher performance of the bias generation function can facilitate a more rugged system topology and lower cost systems solutions when such functions can be fabricated in standard digital mainstream Complementary Metal-Oxide Semiconductor (CMOS) technologies. While battery operation would benefit from low current consuming electronics, however, for next generation batteryless electronics (e.g., batteryless Internet of Things, energy harvesting, biometrics electronics, etc.), ultra low power consuming electronics is a not a 'nice to have' but a 'must have'.

Generally, ultra low power analog and mixed signal electronic systems require large value resistors that may occupy large die sizes. Otherwise, they would require special and additional fabrication layers (which are costly) to deposit high ohm per square resistive material on silicon wafers which makes the use of passive resistors very costly. In order for the new and emerging applications (e.g., energy harvesting, biometrics, consumer medical electronics) to realize their full market size and reach potential expediently, resistor free electronics in small die size are key, and being based in main stream digital CMOS fabrication process manufacturing (that is proven) would be required. Such proven manufacturing platforms help achieve low cost and reduce manufacturing risk so as to facilitate and expedite serving such emerging applications, especially those that require passing regulatory tests (that favor proven manufacturing platforms) such as bio-electronics and consumer bio-metrics applications.

Definitions, Acronyms and Abbreviations

The following terms, definitions, acronyms, term usages and abbreviations are explained below and used throughout this detailed description:

| TERMS | DESCRIPTION |
|---|---|
| Bias current, reference current circuit, and current source | Used interchangeably |
| CMOS | Complementary Metal Oxide Semiconductor (may be operated in subthreshold or normal regions) |
| MOSFET | Metal Oxide Semiconductor Field Effect Transistors (may be operated in subthreshold or normal regions) |
| CMOS, PMOS, NMOS and CMOSFET, PMOSFET, NMOSFET | Used interchangeably |
| Gate, source, drain and gate terminal, source terminal, and drain terminal | Used interchangeably |
| W/L of a MOSFET | Width over length ratio (aspect ratio) of MOSFETs |
| W/L of a MOSFET, scale factors, and aspect ratios | Used interchangeably |
| Ohms per square or Ω/square | Resistivity of material per square area |
| Terms applied to the W/L of MOSFETs such as predetermined, or programmed, or set | Used interchangeably |
| A | Ampere |
| V | Volt |
| N | Nano or $10^{-9}$ (e.g., nA = nano ampere or $10^{-9}$ A |
| BJT | Bipolar Junction Transistor |
| PTAT | Proportional to Absolute Temperature |
| CTAT | Complementary to Absolute Temperature |
| $V_{PTAT}$ | Proportional to Absolute Temperature Voltage |
| $V_{CTAT}$ | Complementary to Absolute Temperature Voltage |
| PTAT signal, CTAT signal, $V_{PTAT}$ signal and $V_{CTAT}$ signal | May be used interchangeably |
| $V_{REF}$ | Reference voltage |
| $V_{BG}$ | Bandgap voltage |
| $I_{REF}$ | Reference current |
| $I_{BIAS}$ | Bias current |
| $R_{BIAS}$ | Bias resistor |
| $R_{BG}$ | Bandgap resistor |
| $V_{EB}$ or $V_{BE}$ | May be used interchangeably as the base emitter voltage of a BJT |
| M | MOSFET carrier mobility |
| $V_T$ | Thermal voltage |
| $C_{OX}$ | Gate oxide capacitance |
| $V_{TH}$ | Threshold voltage of a MOSFET |
| M | To show MOSFET mobility exponent factor used in device equations |
| N | To MOSFET gain factor correction used in device equations |
| $V_{OFS}$ | Offset voltage between MOSFETs |
| $V_{DS}$ | Drain to source voltage of a MOSFET |
| $I_{DS}$, $I_D$ or $ID_{Mxxx}$ | Drain to source current of a MOSFET |
| $V_{GS}$ | Gate to source voltage of a MOSFET |
| TC | Temperature coefficient |
| VC | Voltage coefficient |
| PSRR | Power supply rejection ratio |
| 'a' through 'z' | To show the ratio of MOSFET W/Ls or their aspect ratios used in a circuit design |
| $K_i$ (e.g., $K_a$ or $K_b$) or $S_j$ (e.g., $S_a$ or $S_b$) | To show formulaic constants as a function of either set MOSFET scale factor, or process fabrications constants, or both |
| SC | MOSFET Self-cascode |
| MOSFET's linear, triode, resistive regions of operations | Used interchangeably |

-continued

| TERMS | DESCRIPTION |
|---|---|
| Subthreshold | MOSFET's Subthreshold region of operation |
| Differential source follower, differential voltage follower, differential DC level shifters, unity gain buffers, and differential voltage buffers | Used interchangeably |
| $V_{PTAT}$, $V_{BIAS}$, built in offset voltage | Used interchangeably |
| Resistance and impedance | Used interchangeably |

Figure 2:
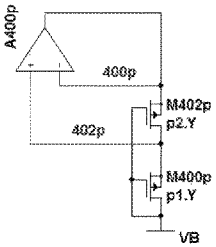
FIG. 2 is an alternative embodiment of FIG. 1 having a functional block diagram of the system and method of generating 'bias current'.
Figure 3:
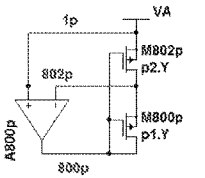
FIG. 3 is another alternative embodiment FIGS. 1 and 2 having functional block diagrams of the system and method of generating 'bias current'.

Here is a brief introduction of the bias current generator block diagram functions (FIGS. 1, 2, and 3). The proposed bias current generation circuit belongs to a class of circuits that uses thermal voltage ($V_T$) as a PTAT signal that work in concert with MOSFET's mobility (μ) as a CTAT signal to generate a current that can be set (predetermined and programmed via MOSFET's W/L ratios, which can be controlled most accurately in fabrication process manufacturing) to be approximately stable with temperature (i.e., have a stable TC) or have a positive or negative TC, depending on the electronics systems need.

The majority of circuit implementations (in the prior art in this category of bias current generation) derail in their current regulation at high temperatures. When operating at ultra low currents, amongst other factors, the MOSFET's small leakage currents (e.g., MOSFET source, drain, body junction diode's leakage) may no longer be ignored, when compared to that of the (also very small) circuit's operating currents. Leakage current especially mounts at hot temperatures and as such they can interfere and derail performance. Although, operating at ultra low currents generally narrows the temperature span due, in part, to standard digital CMOS device leakages, but circuits may be more or less sensitive to leakage depending on topology. For example, in the prior art implementations, where the bias resistors are in series with the source of the current mirror or loop amplifier circuit, such implementations are accompanied with asymmetries induced by mismatched MOSFET W/Ls in order to generate the PTAT signal in current mirrors, loop amplifiers, and or self-cascode cells. Therefore, high temperature operation may, in part, be hindered due to MOSFET source drain body junction diode leakage imbalances. For example, in asymmetric junction diode areas in drain or source terminal's leakage currents pile on (which are hard to match and cancel) as they double every 10 degrees Celsius (10 C)—in a thin ice circuit environment so to speak—where each transistor is already operating in ultra low currents (approximately five to tens of nanoamperes (e.g., more than approximately 5 nA and less than approximately 100 nA).

In order for the leakage current imbalances present in 'signal paths' of current mirror's, or loop amplifier's, or self-cascode's to be contained for a majority of bias current circuit implementations in the prior art, MOSFET aspect ratios need to be somewhat restricted, which limits the magnitude of the $V_{PTAT}$ signal that can be generated. In the subthreshold region (for ultra low current operation), MOSFET's mismatches are dominated by $V_{TH}$ mismatches. The implementation of most of the prior art systems, generally limits the magnitude of the $V_{PTAT}$ signal (to contain leakage), which then makes the topology more sensitive to MOSFET's $V_{TH}$ mismatches. As such, the $V_{TH}$ mismatches become a large part of the intended $V_{PTAT}$ magnitude, which worsens the current source's die yield to specifications. Moreover, in the general cases of the prior art (e.g., when using a self-cascode structure to generate the PTAT signal) the positive TC of $V_T$ term and negative TC of $V_{GS}$ ($V_{TH}$) can push the self-cascode stack off to the edge of the triode-saturation region and derail accuracy of the current reference at min-max temperatures. In the next sections, the proposed embodiments are described along with their benefits.

Suitable for ultra low power and high volume applications, the proposed 'bias current generator' IC belongs to a resistor-free category of CMOS circuits that combines a proportional to absolute temperature (PTAT) signal dependent mostly on pseudo thermal voltage ($V_T$) and a complementary to absolute temperature (CTAT) signal dependent mostly on MOSFET's mobility (μ) to generate a relatively temperature and MOSFET threshold voltage ($V_{TH}$) independent current source, although the embodiments disclosed here can be set to deliver positive or negative TC depending on application need.

First, a brief description of the general embodiments are provided where the 'bias current generator' block diagrams contain 2 basic functions: amplification function (in combination with some $V_{PTAT}$ as a built in offset voltage generation function) and self cascode (SC) function. A subset of variations of the bias current generator's functional block diagrams are depicted in FIGS. 1 and 2 which demonstrate using either NMOS or PMOS self cascode (SC) with respect to a voltage source $V_B$ (e.g., negative power supply). Other variations knowable to those skilled in the art, could include, but not limited to, using n-type metal-oxide-semiconductor field effect transistor (NMOSFET) or p-type metal-oxide-semiconductor field effect transistor (PMOSFET) SC with respect to a positive power supply as well.

Figure 4:
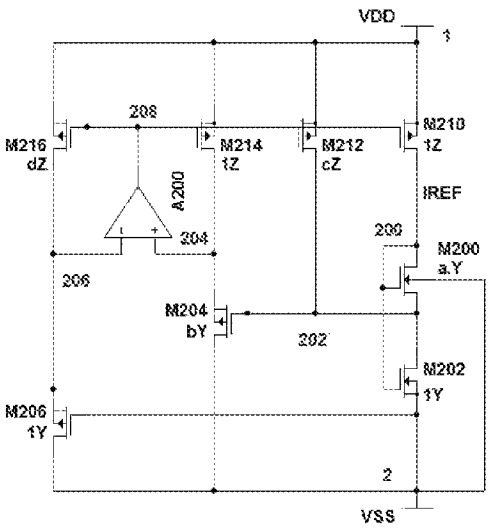
FIG. 4 is a schematic circuit diagram of the embodiment illustrating a bias current source, or regulator, or generator utilizing FIG. 1.

Functional block diagram of FIG. 1 is utilized in bias current source embodiment of FIG. 4. Functional block diagram of FIG. 2 is utilized in embodiment of FIG. 5 (current reference), and FIG. 6 (voltage reference, which can be a pseudo bandgap voltage reference). Functional block diagram of FIG. 3 is utilized in embodiment of FIG. 7 (bandgap voltage reference). The specific embodiments of each of the FIGS. 4, 5, 6, and 7 will be described below in detail.

The simplified block diagrams in FIGS. 1, 2, and 3 could contain elements such as amplifiers. The amplifier is defined herein broadly. For example, it could be a voltage output or current output amplifier, or have voltage output combined with voltage controlled current source or VCCS. Such an amplifier, could also contain differential buffers (e.g., differential source followers, DC level shifters, voltage offset generators in series with its differential inputs). Other elements contained here could be voltage followers, DC level shifters, voltage offset generators, independent Voltage Controlled Current Sources (VCCS), current mirrors, bias current or current generator circuits, self-cascodes, and MOS transistors (e.g., MOS transistors can be configured to function as an active resistor, or VCCS, current mirrors, current sources or active resistors or can be paired in the input of an amplifier or buffer or DC level shifter—with differing scale factors—to generate offset voltage).

In FIGS. 1, 2, and 3, the amplifiers $A_{200n}$, and $A_{400p}$, and $A_{800p}$ (respectively) combined with or embed offset voltage (i.e., multiple of $V_T$ or $V_{PTAT}$) generation circuits. Note that although $V_T$ is generally thermal voltage associated with BJTs. However, when operating multiple MOSFETs (which are scaled differently or are operated at different quiescent currents) in a subthreshold region, a pseudo $V_T$ term may be realized as a function of their gate terminal to source terminals voltage ($V_{GS}$) differences which is what is done here. The described amplifiers, generate and force the $I_{BIAS}$ current (i.e., $ID_{M202n}$, $ID_{M402p}$, $ID_{M802p}$) through the self cascode MOSFETs (i.e., $M_{200n}$-$M_{202n}$, $M_{400p}$-$M_{402p}$, $M_{800p}$-$M_{802p}$) until the inputs of said amplifiers are substantially equalized with some amplitude of $V_{PTAT}$ that can be set by W/L of input MOSFETs (e.g., combining the $V_{PTAT}$ generation and amplification circuits). Note that the $I_{BIAS}$ can be set to generate a positive, negative, or stable TC depending on settings of MOSFET's W/L ratios. The PTAT signal is mostly contributed via pseudo thermal voltage, or pseudo $V_T$, derived from the built in or programmed offset voltages that can be generated by subthreshold MOSFET of the differential inputs, at their gates (e.g., of either the amplifier or voltage followers or combination thereof). The CTAT signal is mostly contributed via μ of the resistive MOSFET that is contained in the self-cascode.

Node description of FIG. 1 is as follows: node 200*n* is connected to the output of $A_{200n}$, drain and gate of $M_{200n}$, and gate of $M_{202n}$. Node 202*n* is connected to sources and body of $M_{200n}$, drain of $M_{202n}$, and input of $A_{200n}$. Node $V_B$ is connected to voltage source, the other input of $A_{200n}$, and source and body of $M_{202n}$.

Node description of FIG. 2 is as follows: node 400*p* is connected to the output of $A_{400p}$, drain and gate of $M_{400p}$, and gate of $M_{402p}$. Node 402*p* is connected to sources and body of $M_{400p}$, drain of $M_{402p}$, and input of $A_{400p}$. Node $V_B$ is connected to voltage source $V_B$, the other input of $A_{400p}$, and source and body of $M_{402p}$.

Node description of FIG. 3 is as follows: node 800*p* is connected to the output of $A_{800p}$, drain and gate of $M_{800p}$, and gate of $M_{802p}$. Node 802*p* is connected to sources and body of $M_{800p}$, drain of $M_{802p}$, and input of $A_{800p}$. Node 1*p* is connected to voltage source $V_A$, the other input of $A_{800p}$, and source and body of $M_{802p}$.

In FIGS. 1, 2, and 3, the MOSFET aspect ratios $p_1$, $p_2$, $n_1$, and $n_2$ can be predetermined or programmed from approximately 0.1 to approximately 20. Note that there are other variations of this embodiment. For example, self cascodes (SC) can be NMOS or PMOS types with their body terminal shorted to the sources or to voltage sources (e.g., a supply voltage), and the SC's operating current can be supplied with $I_{BIAS}$ via a VCCS from the positive or negative supply or other voltage source terminals. The amplifier block (i.e., $A_{200n}$, $A_{400p}$, and $A_{800p}$) can be a voltage output or current output (e.g., trans conductance amplifier) or an amplifier with a built in offset, or series combination of an amplifier with no built offset plus source followers (or DC level shifters) with built in offsets that generates a $V_{PTAT}$ signal.

In summary, the higher performance of the bias current generator shown in block diagrams of FIGS. 1, 2, and 3 or their other variations are achieved in part by sensing the $V_{PTAT}$ and forcing the $I_{BIAS}$ at the 'gate' and not the 'source' terminal of the reference current mirror or loop amplifier. In effect, the $V_{PTAT}$ is generated and applied at the gate of the current mirror or loop amplifier. In such a configuration, the active MOS resistor ($R_{BIAS}$) in series with the gate of the current mirror or loop amplifier, and the $I_{BIAS}$ is flowing through the active MOS resistor drain to source terminals. There are additional benefits in this bias current generator, such as more flexibility, enhanced AC and transient response, less leakage, more rugged topology for manufacturability, which will be discussed in more details herein. Moreover, there are extended and combinational benefits when utilizing this bias generator function in combination with other higher level analog functions such as a current reference (i.e., FIGS. 4 and 5) and voltage reference (i.e., FIGS. 6 and 7), which will be also described in more detail in subsequent sections.

Placing the MOSFET of self cascode that establishes the $R_{BIAS}$ (i.e., $M_{202n}$, $M_{402p}$, $M_{802p}$) in 'gate' and not the 'source' terminal of the current mirror or loop amplifier, effectively places the $R_{BIAS}$ function into the feedback loop of the current mirror amplifier signal path. One benefit of this feature is that, in effect, the open loop amplification in effect reduces the impedance effect of the $R_{BIAS}$ (which is in the mega ohms level for ultra low currents) at output and input nodes of the current mirror or loop amplifier.

These implementations allows for the flexibility and having the option of employing differential source followers to generate a larger $V_{PTAT}$ (instead of prior art use of either asymmetric current mirror's or loop amplifier's source terminal connected to $R_{BIAS}$ or scaled self-cascode, which in part can limit optimal amplitude for the $V_{PTAT}$ signal). This method's flexibility allows for larger $V_{PTAT}$ which helps desensitize $I_{BIAS}$ from offsets (e.g., due to normal manufacturing $V_{TH}$ and W/L mismatches associated with transistors in current mirror and loop amplifier). Therefore the $I_{BIAS}$ could be more insensitive to standard digital CMOS process fabrication variations and mismatches.

Source drain junctions of MOSFETs have leakage current that double with every 10 C rise in temperature. The proposed bias current generator topology allows for reduction of the impact of asymmetric aspect ratios for MOSFETs, and the narrowing their undesirable impact of their associated source drain junction leakages, for example in the cascoded current mirrors, in the $I_{BIAS}$ current mirror or current loop amplifier.

This bias current generation scheme provides the option of utilizing NMOSFET or PMOSFET self cascodes where with respect to either the positive and negative power supply. For example, this is demonstrated in FIG. 1 with NMOSFET SC and FIG. 2 with PMOSFET SC, where both implementations are with respect to $V_B$ which can be a negative power supply. However, in FIG. 3, a PMOSFET SC is implemented with respect to $V_A$, which can be a positive power supply. This feature can have several benefits, including but not limited to, more power supply head room, higher PSRR, and more system topology flexibility in setting the bias current with respect to either positive or negative power supplies.

Another benefit of this bias current generation scheme is that it allows for negative power or $V_{SS}$ and ground potential (GND) to be same, as well as allowing for decoupling of negative power or $V_{SS}$ from ground (GND), where technically $V_{SS}$ can run at a lower voltage than the ground potential. As a result, the bias current value may be set relative to either GND or $V_{SS}$ depending on electronics system requirement, which provides for more system topology flexibility.

In summary, the benefits of the bias current generation circuit may include: the proposed topology can deliver current consumption in the tens of nanoamperes (nA) range (i.e., more than approximately 10 nA and less than approximately 100 nA) operate with sub 1 volt supply voltage in a small die size that is 4 to 50 times smaller in size, compared to prior art current references in its category. Benefits of this current reference may include: low cost, higher temperature span, low voltage coefficient (VC), wider TC and $V_{DD}$ span. The impact of source-drain junction leakages is reduced and hot temperature span of the bias current generator is extended. Low power supply operation at ultra low current can be achieved in part because of the flexibility of the bias current generation scheme. Power supply rejection ratio (PSRR) and other AC performance are enhanced. The overall benefit of this class of bias current generators is retained, including for example, that it can operate in sub-threshold, which keeps current consumption low and enables lower $V_{DD}$ operation. Moreover, the impact of process fabrication variation on performance is contained and controlled given the significantly less sensitivity of the bias current generation to $V_{TH}$ and dependence on μ, which is more tightly controlled in fabrication process. Moreover, low cost is also achieved because in part the proposed topology does not require any passive resistors. Low cost is also achieved by proposed topology's small die size that may be based in standard digital CMOS, making the topology portable to multiple digital standard CMOS fabrication facilities. Also, basing the topology on standard digital CMOS fabrication process (without any custom or special devices) facilitates process portability which should help speeding up regulatory bodies qualification of new products (i.e., biometric ICs) who view standard manufacturing ICs much more favorably.

Description of the FIG. 4 Embodiment in a 'Bias Current Source'

The first utilization of the functional block diagram of FIG. 1 (bias current generation) is embodied in the 'bias current source' that is depicted in FIG. 4 which can contain elements such as amplifiers. The amplifier is defined here broadly, which could be a voltage output or current output, or have voltage output combined with voltage controlled current source or VCCS. Such an amplifier could also contain differential buffers (e.g., differential source followers, DC level shifters, voltage offset generators in series with its differential inputs). Other elements contained here could be independent voltage followers, DC level shifters, voltage offset generators, voltage controlled current source (VCCS), current mirrors, bias current or current generator circuits, self-cascodes, and MOS transistors (e.g., MOS transistors can be configured to function as an active resistor, or VCCS, current mirrors, current sources or active resistors or can be paired in the input of an amplifier or buffer or DC level shifter—with differing scale factors—to generate offset voltages).

Here is a brief summary of the description and benefits of the embodiment of FIG. 4, which flow from functional block diagram of the embodiment shown in Figure (and its various benefits that were just summarized in the previous section).

Suitable for ultra low power applications, including energy harvesting, the proposed 'bias current source' embodiment belongs to a resistor-free category of CMOS circuits that combines a PTAT signal dependent mostly on $V_T$ and CTAT signal dependent mostly on MOSFET's μ to generate a relatively temperature and $V_{TH}$ independent current source. The proposed topology consumes ultra lower currents (e.g., 50 nA to 500 nA) and can operate with sub-1V $V_{DD}$. The simplicity of the topology, in part, enables its small size, compared to prior art current references in its category. It has the potential for wider temperature compared to its alternatives. Higher temperature span may be achieved by the following. First, sensing the PTAT voltage and forcing the $I_{BIAS}$ at the gate and not the source of the reference current mirror or loop amplifier. In effect this topology, places the $R_{BIAS}$ (and the development of $V_{BIAS}$) in series with the gate as opposed to in series with the source of the current mirror or loop amplifier. Second, having the option of using differential source followers to generate a larger PTAT voltage instead of prior art use of either asymmetric MOSFETs in the current mirror or current loop amplifier and or scaled self-cascode. Third, using donut shaped equal W/L transistors in a circuit layout to minimize the drain size for less leakage current.

This embodiment allows for larger PTAT voltage, which helps desensitize $I_{BIAS}$ from error contributions of normal mismatches and offset and fabrication process variations (e.g., $V_{TH}$ and W/L mismatches associated with transistors in current mirror and loop amplifier). The proposed topology allows for minimization or elimination of the impact of asymmetric transistors and cascoded current mirrors in the current reference ($I_{REF}$ or $I_R$ or $I_r$) loop. As a result, compact die size is realized, the impact of source-drain junction leakages is reduced substantially, and hot temperature span is extended.

In FIG. 4, the signal loop that generates the operating current, or $I_{BIAS}$, of the circuit consist of $M_{202}$ (which makes the active CMOS resistor, $R_{BIAS}$ or $R_{M202}$), source followers $M_{204}$ and $M_{206}$, voltage amplifier $A_{200}$, and PMOS transistors $M_{210}$-$M_{216}$. Note that all transistors used in this embodiment of FIG. 4 circuitry operate in the subthreshold region to keep the power supply headroom and current consumption low, but this topology is not limited to subthreshold operation. The active resistor MOSFET, $M_{200}$, operating in triode, takes a small die size but can generate high value resistor ($R_{M202}$) needed for ultra low power applications. As noted earlier, this would otherwise be impractical (due to large size or high cost of additional thin film resistor layer) with the available passive resistor in standard digital CMOS fabrication. Transistors $M_{214}$ and $M_{216}$ (where aspect ratio or $W/L_{M216}$ over $W/L_{M214}$ is 'd') function as current sources for the source follower differential pairs composed of $M_{204}$ (biased by $ID_{M214}$) and $M_{206}$ (biased by $ID_{M216}$) that have a built in offset voltage (set by aspect ratios of $M_{204}$ over $M_{206}$ that is 'b') which help generate the PTAT term $V_T$.ln (bxd) or $V_{BIAS}$ or $V_{PTAT}$. Note that the active MOS resistor, $M_{202}$, which is the $R_{BIAS}$, is in series with the gates of source followers, $M_{204}$ and $M_{206}$, that feed the inputs of the current loop amplifier, $A_{200}$. This in effect, places the $R_{BIAS}$ and generation of the $V_{BIAS}$ (or $V_{PTAT}$) applied to the gate of loop amplifier, $A_{200}$. The amplifier $A_{200}$ substantially equalizes its inputs which are the source terminals voltages of $M_{204}$ and $M_{206}$ by forcing the gate voltages of transistors $M_{210}$ and $M_{212}$ (which operate as a voltage controlled current source (VCCS)). Accordingly, operating currents $ID_{M210}$ and $ID_{M212}$ flow through $R_{M202}$ whose operating current scales in proportion with $I_{BIAS}$. The value of $R_{M202}$ or $R_{BIAS}$ is a function of $I_{BIAS}$ as well as being set in part by the $SC_{200}$ (composed of $M_{200}$ and $M_{202}$) W/Ls and MOSFETs mobility (μ), which helps generate the CTAT term. Note that in FIG. 4 the scale factors a, b, c, and d are the ratios of transistor's width over length (W/L or scale factors or aspect ratios) that may be programmed or predetermined from approximately 0.1 to approximately 50 (but for that can be zero that is eliminating $M_{212}$) depending on such considerations as die size and various operating specifications, including but not limited to current consumption, temperature coefficients, and power supply range objectives.

The connections of the elements in FIG. 4 are described as follows. Node 1 is the positive supply voltage terminal or $V_{DD}$. Node 2 is the negative supply voltage terminal or $V_{SS}$ (which can also be set as the zero voltage terminal or ground). The source and body terminals of transistors $M_{210}$, $M_{212}$, $M_{214}$, and $M_{216}$ are connected to node 1. Node 2 is connected to source and bodies of $M_{202}$, $M_{204}$, and $M_{206}$, as well as the body of $M_{200}$. Transistors $M_{200}$ and $M_{202}$ form the self cascode, where the diode connected $M_{200}$ is cascoded with $M_{202}$. Node 200 is connected to the gate and drain terminals of $M_{200}$ as well as to the gate of $M_{202}$ plus drain of $M_{210}$. Node 202 is connected to the source terminal of $M_{200}$, and drain terminal of $M_{202}$, and gate of $M_{204}$, and drain of $M_{212}$. Note that the body terminal of $M_{200}$ can be connected to either its source at node 202 or to node 2, depending on the process fabrication. In this embodiment, the body terminals of $M_{200}$ and $M_{202}$ are connected to node 2. Moreover, here the PTAT voltage is generated by using two source followers with a built in offset voltage, which is formed by transistors $M_{204}$ and $M_{206}$ combined with current sources supplied by $M_{214}$ and $M_{216}$. Node 204 is connected to the source and body of $M_{204}$, drain of $M_{214}$ and positive input of $A_{200}$. Node 206 is connected to body and source of $M_{206}$, drain of $M_{216}$, and negative input of $A_{200}$. Note that $M_{210}$, $M_{212}$, $M_{214}$, and $M_{216}$ function as current mirrors. Node 208 is connected to the output terminal of amplifier $A_{200}$, and it is connected to the gates of transistors $M_{210}$, $M_{212}$, $M_{214}$, and $M_{216}$. The drain current or $I_D$ of $M_{208}$ constitutes the bias current of the circuit or reference current, $I_{BIAS}$.

In FIG. 4 there is the first voltage loop consisting of $M_{202}$, $M_{204}$, $A_{200}$, and $M_{206}$ produce a PTAT signal as a function of $V_T$ which is forced upon the $V_{DS}$ of $M_{202}$ by the operation of the $M_{204}$ and $M_{206}$ source followers (which carry the built in offset as a function of PTAT signal), the current source's loop amplifier $A_{200}$, and current mirrors $M_{216}$, $M_{214}$, $M_{212}$, and $M_{210}$ on the self cascode $SC_{200}$. There is also a second voltage loop consisting of $M_{200}$ and $M_{202}$ where $M_{200}$ operates in saturation and $M_{202}$ operates in the triode region (i.e., that is acting as an active MOS resistor of $R_{M202}=R_{BIAS}$ for this current source). The active MOS resistor; while functioning as the current source's resistor, contributes to a CTAT signal being mostly a function of μ. Application of PTAT signal via $V_T$ while interacting with CTAT signal via μ whose combination (using different MOSFET aspect ratios) can facilitate making a positive TC, or negative TC, as well as a stable TC for the $I_{BIAS}$. Note that for demonstrative clarity of the proceeding formulations, second order effects—including but not limited to—early voltage, body effect, and subthreshold slope factor TC are ignored:

$$VGS_{M202}-VGS_{M200}=VDS_{M202};$$

$$R_{BIAS}=R_{M202}\approx[\mu.C_{OX}.(W/L)_{M202}(VGS_{M202}-V_{THn}-VDS_{M202}/2)]^{-1};$$

$$VGS_{M202}\approx[2I_{BIAS}/\mu.C_{OX}.(W/L)_{M200}]^{1/2}+V_{THn};$$

$$VGS_{M206}-VGS_{M204}=[V_T.\ln(d\times b)]=VDS_{M202};$$

$$VDS_{M202}\approx I_{BIAS}(c+1)\times R_{M202}\approx[V_T.\ln(d\times b)];$$

$$\mu.C_{OX}.(W/L)_{M202}\times[I_{BIAS}/\mu.C_{OX}.(W/L)_{M200}]^{1/2}\approx I_{BIAS}(c+1)\times[V_T.\ln(d\times b)]^{-1};\text{ and}$$

$$I_{BIAS}\approx f(S_{202},\mu,V_T).$$

It can be noticed that $V_{TH}$ term is canceled out in both the first loop ($M_{204}$, $A_{200}$, $M_{206}$) and the second loop ($M_{200}$, $M_{202}$). This trait can significantly reduce $I_{BIAS}$'S sensitivity to $V_{TH}$, where $V_{TH}$ has substantial variations in process fabrication and manufacturing (e.g., $V_{TH}$ nominal at 0.4V with +/−50% variation). As it is the case with this class of current sources, $I_{BIAS}$ is primarily a function of $C_{OX}$, $V_T$, and u. Here $C_{OX}$ is a function of gate oxide thickness which has a very low temperature coefficient, $V_T$ has a positive TC (PTAT like) and μ has a negative TC (CTAT like). Therefore, the TC of $I_{BIAS}$ can be positive or negative or approximately flat depending on the abbreviated formulaic constant (scalar), $S_{202}$, which is function of MOSFET's aspect ratios a, b, and d as well as MOSFET device constants.

In this section some of the benefits of the utilization of the embodiment of FIG. 1 that is embodied in FIG. 4 are described. As noted earlier, the PTAT voltage or $V_{PTAT}$ or $V_{BIAS}$ of the current source is applied across an active resistor, $R_{BIAS}$, at the gate terminal compared to the prior art (see FIG. 11 and FIG. 12) that does it at MOSFET's source terminal of the PTAT voltage generation circuit.

Figure 11:
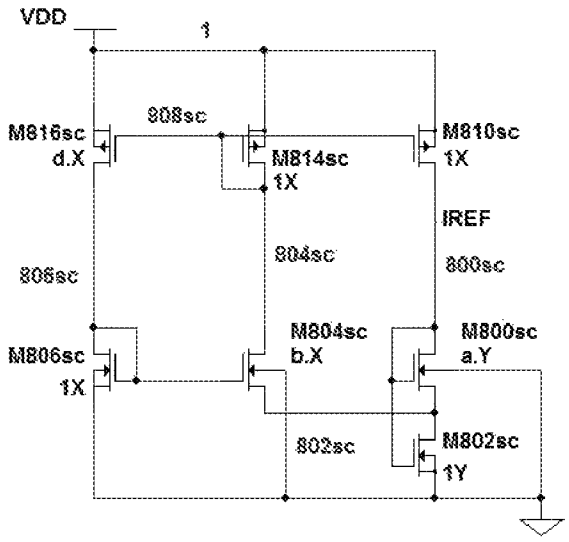
Prior Art Figure 11
FIG. 11 is a schematic circuit diagram of an embodiment illustrating a prior art current source.
Figure 12:
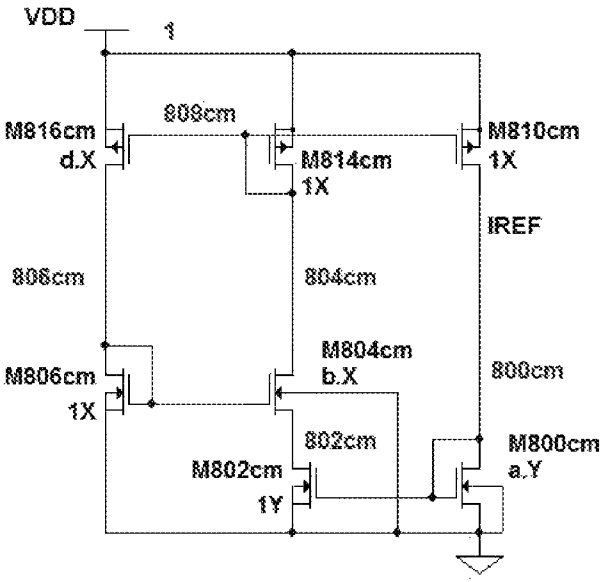
Prior Art Figure 12
FIG. 12 is a schematic circuit diagram of an embodiment illustrating another prior art current source.

In both prior art examples depicted in FIG. 11 and FIG. 12, $M_{802sc}$ or $M_{802cm}$ which are the active MOSFET resistor (forming the $R_{BIAS}$) are placed in series with the source terminal of $M_{804sc}$ or $M_{804cm}$, that are part of the $M_{804sc}$-$M_{806sc}$ or $M_{804cm}$-$M_{806cm}$ which is part of the circuit that generates the PTAT voltage (or $V_{BIAS}$ or $V_{PTAT}$) that is applied across $R_{BIAS}$ to make the $I_{BIAS}$ (=$V_{BIAS}/R_{BIAS}$).

However, in this invention shown in FIG. 1 (or its equivalent variations FIG. 2 and FIG. 3) embodied in FIG. 4, the active MOSFET resistor $M_{202}$ which forms the $R_{BIAS}$ (where the $V_{PTAT}$ or $V_{BIAS}$ or $V_{PTAT}$ signal is applied) is placed in series with the gate of $M_{204}$ that is part of the $M_{204}$-$M_{206}$, which is part of the circuit that generates the $V_{PTAT}$ or $V_{BIAS}$, which makes the $I_{BIAS}$ (=$V_{BIAS}/R_{BIAS}$). Placing the $R_{BIAS}$ with the gate terminal of the PTAT signal generation circuit has many benefits, some of which are explained below.

In the FIG. 4 embodiment, a larger $V_{PTAT}$ can be generated via $M_{204}$ and $M_{206}$ differential source followers with larger asymmetric W/L ratios to make a larger built in offset voltage. The drains of the followers $M_{204}$ and $M_{206}$ are shorted to ground, which shorts their junction leakages also to ground. Donut shaped (in layout) M204 and M206 also help reduce the junction areas and their associated leakages. In this manner the $V_{PTAT}$ generation function (i.e., the built in offset of the differential source followers) is separated from the function of current mirror or loop amplifier. As such, a current mirror or current loop amplifier can be constructed with complete symmetry (i.e., equal W/L ratios). Therefore, the bias current's high temperature regulation span is widened via minimizing current leakage in key signal paths because asymmetries in the current mirror or loop amplifiers associated with prior art implementations can be eliminated or reduced, and more of the drain or source junctions areas and their associated leakage currents are shorted to power supplies. As noted earlier, most prior art implementations, employ asymmetries by scaling-in offsets in current mirrors, loop amplifiers, and or self-cascade cells for $V_T$ generation. As such, high temperature operation is in part hindered due to imbalances in asymmetric junction diode areas in drain or source terminals (which are hard to match and cancel out) and whose leakage currents pile on and double every 10 C—in a thin ice circuit environment so to speak—where each transistor is already operating in ultra low currents (five to tens of nano amperes).

For some of prior art implementations, it could be that in order for current mirror's, or loop amplifier's, or self-cascode's leakages to be contained (and ultimately its hot temperature performance less hindered), the W/L (or area) of pertinent MOSFETs had to be somewhat restricted, which limits the allowed amplitude of $V_{PTAT}$ that can be generated (e.g., approximately 50 mV versus 150 mV). Note again that Voltage Proportional to Absolute Temperature ($V_{PTAT}$) is generally generated via the difference in $V_{GS}$ of two MOSFETs that operate in subthreshold, but whose W/L and or quiescent currents are scaled differently. A circuit topology for reliable manufacturing would benefit from a $V_{PTAT}$ whose amount is set by W/L ratios and $V_T$ (which are accurately controlled) as opposed to being dominated from example by $V_{TH}$ mismatch between the two pair of MOSFETS. The prior art is restricted to smaller amount of $V_{PTAT}$ (e.g., 50 mV) which is a disadvantage because it would increase the impact of normal process fabrication mismatches and offsets on controlling the value of $I_{BIAS}$ to specifications in manufacturing, and ultimately the yield of $I_{BIAS}$ to the target specifications. For example, a contribution of 5 mV of $V_{OFS}$ (mismatch between two MOSFETs) to a 50 mV of $V_{PTAT}$ is 10% offset error contribution to $V_{PTAT}$ which is the case with some of the prior art. However, 5 mV of $V_{OFS}$ over 150 mV $V_{PTAT}$ is 3% offset error contribution to $V_{PTAT}$ which can be the case with this embodiment's topology. In the embodiment of FIG. 4, by having the option of using source followers to generate the PTAT terms, the drain junction and their associated leakage are shorted to the negative supply which helps higher temperature span. An additional benefit of this embodiment besides the (some relief) greater freedom from derailment of hot performance due to drain or source junction current leakages, the differential source follower in FIG. 4 can be constructed for higher value $V_{PTAT}$ (e.g., $M_{204}$ and $M_{206}$ aspect ratios >approximately 16× vs. prior art equivalent PTAT generator aspect ratio~4-6×). As such, $V_{TH}$ mismatch (of the loop amplifier or current mirror) within the current loop equation becomes a smaller percent contributor to $I_{BIAS}$ overall (in)accuracy. This in turn allows for using smaller transistors that would leak less and hence help extend the temperature span.

Note also that in the general cases of prior art (where a self-cascode structure is employed to generate the PTAT term) the positive TC of $V_T$.ln (bxd) and negative TC of $V_{GS}$ (or $V_{TH}$) can push the self-cascode stack off to the edge of triode-saturation region and derail accuracy of current reference at min-max temperatures. Also, in the FIG. 4 embodiment, employing source follower (that also function as voltage buffers) to drive the input terminals of the loop amplifier, $A_{200}$, would help loop stability and enhance AC and transient response of this current source topology. This topology places the $R_{BIAS}$ in the input-output feedback loop of the current mirror amplification function, which helps its DC and AC performance (e.g., the impact of the ultra high resistance value of $R_{BIAS}$, needed for ultra low current operation, can be attenuated by the gain of the current mirror loop amplifier). Another benefit of the FIG. 4 embodiment is that by establishing the $I_{BIAS}$ via $R_{BIAS}$ in the gate of current mirror loop (via amplifier $A_{200}$), it provides more flexibility for scaling (via scale factor c) $M_{210}$ and $M_{212}$ to set the value $VDS_{M202}$ and hence the value of $I_{BIAS}$. Moreover, this move also helps with balancing $V_{DS}$ across PMOSFETs non-cascade current source $M_{210}$, $M_{212}$, $M_{214}$, and $M_{216}$ pairs, which eliminates the need to use cascoded current mirrors (otherwise needed to avoid MOSFET's early voltage induced current mismatch). Moreover, another advantage of FIG. 4 embodiment is that, in part, due to balanced $V_{DS}$ across $M_{210}$, $M_{212}$, $M_{214}$, and $M_{216}$, the VC, PSRR, and TC performance is not compromised despite smaller but equal sized W/L transistors (e.g., L=1 micron for all NMOS and PMOS). Additionally, another advantage of the embodiment of FIG. 4 is that the prior art's use of cascoded current mirrors with unequal source-drain junction areas (and their respective junction leakages which double with every 100 increase in temperature) are avoided, which in turn helps with higher temperature span of this embodiment. Retaining the benefits of the class of bias current sources to which it belong, an advantage of the embodiment of FIG. 4 is it allows operation of MOS transistors in subthreshold, which enables low power supply and ultra low power consumption. Also, as noted earlier, the embodiment of FIG. 4 is substantially independent of $V_{TH}$ and mostly depended on μ, which is better controlled in process fabrication, hence the overall power consumption of the bias current source is more tightly controlled over process variations. Having the flexibility of using NMOS or PMOS SC (self cascade) with respect to either of positive or negative power suppliers, another benefit of the embodiment of FIG. 4 is using such flexibility for the bias current source to operate with sub 1V power supply (i.e., minimum $V_{DD}$ is limited to only subthreshold $V_{GS}+2V_{DS}$). Another benefit of the FIG. 4 embodiment is that $V_{SS}$ (negative power supply) and the ground connection (GND) may be the same of separated, depending on system requirements, which allows $I_{BIAS}$ to be set in value independent of the ground potential.

Figure 5:
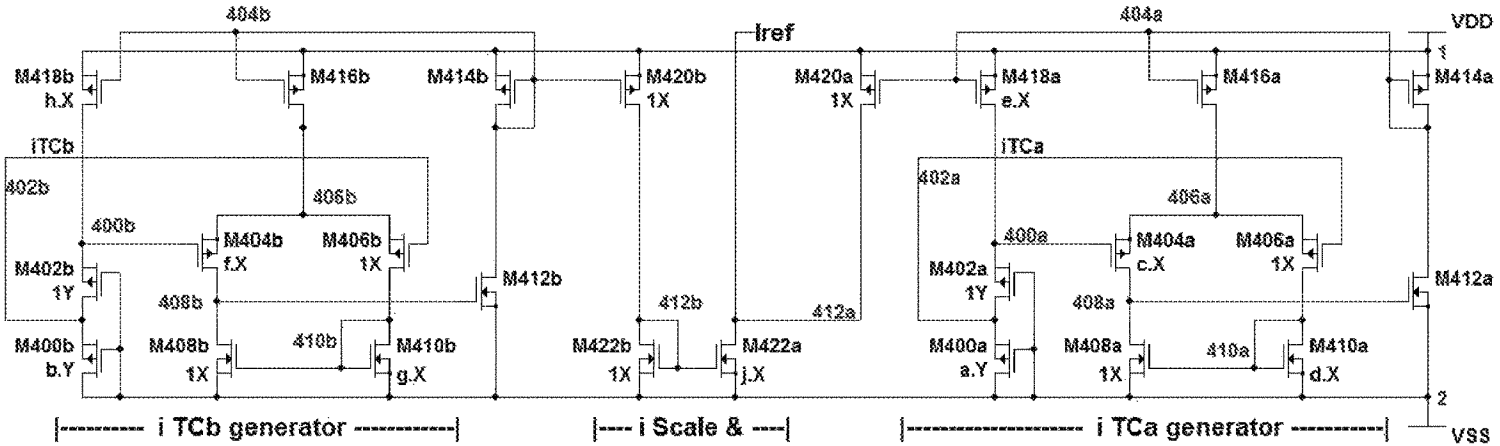
FIG. 5 is a schematic circuit diagram of the embodiment illustrating a current reference, or source, or regulator, or generator utilizing FIG. 2.

Description of the FIG. 5 Embodiment in a 'Current Reference'

Employing the functional block diagram of FIG. 2 (which is a variation of that of FIG. 1) is utilized in the embodiment of a current reference that is depicted in FIG. 5. The embodiment of FIG. 5 includes current generator $I_{TCa}$, current generator $I_{TCb}$, and current scalar and subtractor which outputs the 'current reference', $I_{REF}$. One of the goals of utilizing the embodiment of FIG. 2 in the embodiment of FIG. 5 is to make current reference that is ultra low power, resistor free, whose operating condition are mostly independent of $V_{TH}$, based in CMOS process fabrication, where there is greater level of flexibility in programming or predetermining MOSFET's W/L sizes or ratios, to make a high performance $I_{REF}$ with positive, negative, or stable TC.

The following is a description of the embodiment of FIG. 5. Typical reference topologies add two currents with opposing temperature coefficient (TC) polarities to generate a stable TC current, whereas this reference generates two currents ($I_{TCa}$ and $I_{TCb}$) with same polarity TCs that are scaled with differing slopes, and subsequently scaled and subtracted from each other to form a positive or negative TC as well as a stable TC $I_{REF}$. Here is how: in FIG. 5, the two currents, $I_{TCa}$ and $I_{TCb}$ are generated across two PMOSFETs, $M_{402a}$ and $M_{402b}$, as part of a pair of self-cascodes, $SC_{400a}$ and $SC_{400b}$. Loop amplifiers $A_{400a}$ and $A_{400b}$ operating in conjunction with the SCs force $VDS_{M402a}$ and $VDS_{M402b}$ to equal $V_T$.ln(cxd) and $V_T$.ln(fxg), respectively, which are the built-in offset voltages of $A_{400a}$ and $A_{400b}$, respectively. Note here that the $V_{PTAT}$ signal is not generated via the source followers or DC level shifters (which was the case with the functional block diagram of FIG. 1 when utilized in the embodiment of FIG. 4). Instead, the $V_{PTAT}$ signal is initiated via a built in offset voltages that is generated by scaling (and or operating their quiescent current) differently the amplifier's input MOSFETs, which operate in the subthreshold region. The TC and magnitude of $I_{TCa}=VDS_{M402a}/R_{M402a}$ and $I_{TCb}=VDS_{M402b}/R_{M402b}$ can be sloped differently via (mostly by) adjustments in setting the ratio of W/Ls of $M_{400a}$-$M_{402a}$ (i.e., mostly set by 'a') different from $M_{400b}$-$M_{402b}$ (i.e., mostly set by 'b') while adhering to matching considerations by using the same narrow W and long L (i.e., Y) for $M_{400a}$-$M_{402a}$ and $M_{400b}$-$M_{402b}$. Here the $TC_a$ of $R_{402a}$ in the denominator of $I_{TCa}$ (with equally sized $M_{400a}$-$M_{402a}$ in $SC_{400a}$) is sloped differently from $TC_b$ of $R_{402b}$ in the denominator of $I_{TCb}$ (with differently sized $M_{400b}$-$M_{402b}$ in $SC_{400b}$) by sizing b>a. Hence, apples-to-apples, there is less $R_{M402a}$ contraction in resistance via increasing $VGS_{M400a}$ at higher temperatures, since $VGS_{M402a}-VGS_{M400a}=VDS_{M402a}=VT.\ln(cxd)$.

As noted earlier, the proposed topology allows for magnitude and TC of $I_{TCa}$ and $I_{TCb}$ be set with some independence from one another using device aspect ratios, while it employs substantially identical topology mechanisms to generate $I_{TCa}$ and $I_{TCb}$—which improves performance over power supply, temperature, and fabrication process variations. Concurrently, $I_{TCa}$ and $I_{TCb}$ (whose TCs and amplitudes are set partially independently from one another by adjustments to their MOSFET's aspect ratios) are fed into a current scalar and subtraction circuit, which scales $(K_{400a}.I_{TCa})$ to $S_{400}\cdot(K_{400a}.I_{TCa})$ whose value changes by the same amount as $K_{400b}.I_{TCb}$ over an objective temperature span. This resultant current or $S_{400}\cdot(K_{400a}.I_{TCa})$ and $K_{400b}.I_{TCb}$ are subtracted from each other to yield an $I_{REF}$. All generated currents are mostly independent of $V_{TH}$ and primarily a function of MOSFET's μ and $V_T$, thus helping stable specifications of $I_{REF}$ over fabrication process variations. Note that $I_{REF}$ can also be programmed to have a negative or positive TC via wider flexibility in choosing different MOSFET's W/L ratios in the generation of $I_{TCa}$, $I_{TCb}$, and the scalar factor (e.g., $S_{400}$, $K_{400a}$ and $K_{400b}$, which is a formulaic representation of MOSFET W/L ratios as well as MOSFET's device parameter constants) in the current scalar subtraction circuit.

This second utilization of the embodiment of FIG. 2 in the embodiment depicted in FIG. 5 includes elements such as amplifiers. The amplifier could be a voltage output or current output or have voltage output combined with voltage controlled current source or VCCS. Such amplifier, could also contain differential buffers (e.g., differential source followers, DC level shifters, voltage offset generators in series with its differential inputs). Other elements contained here could be voltage followers, DC level shifters, voltage offset generators, current mirrors, voltage controlled current source (VCCS), bias current or current generator circuits with differing TC, self-cascodes, current scale and subtractor circuit, and MOS transistors (e.g., MOS transistors can be configured to function as a VCCS, current mirror, current sources or active resistors or can be paired in the input of an amplifier or buffer or DC level shifter—with differing scale factors—to generate offset voltage).

As noted earlier, the same principles of this embodiments of the functional block diagram of FIG. 1 or its variation FIG. 2 can be utilized in the embodiment of FIG. 5. Here two independent bias current generators are utilized. For each of bias current generator, the $R_{BIASa,b}$ ($R_{M402a,b}$) remains in the feedback loop of the current loop amplifier, and it is connected to the gate and not the source of the loop amplifier ($V_{BIAS}$ which is the $V_{PTAT}$ signal is not applied in series with the source terminal of the current mirror loop or loop amplifier). Note that other variations where a bias current generator (of FIG. 1 or FIG. 2) with $R_{BIASa}$ is connected to the gate, and can be combined with a bias current generators where $R_{BIASb}$ is connected to the source, which can offer a different cost performance characteristic. Another variation can be to have $R_{BIASa}$ be based on an NMOS active resistor (as in FIG. 1), and the other $R_{BIASb}$ be based on a PMOS active resistor (as in FIG. 2), where the process variations and relations between NMOS and PMOS can offer other cost performance traits. The embodiments shown in FIGS. 1 and 2 provide the flexibility to generate currents of $I_{TCa}$ and $I_{TCb}$ with two different TCs before they are scaled and subtracted from one another to generate the $I_{REF}$ of interest. Also, note that all transistors used in this embodiment of FIG. 5 circuitry operate in the subthreshold region, but this topology is not limited to subthreshold operation.

Firstly, here are more details describing how current generator $I_{TCa}$ yields a current with $TC_a$. The signal loop that generates $I_{TCa}$ includes $M_{402a}$, which makes the active CMOS resistor, $R_{M402a}$ (i.e. $R_{BIASa}$). The active transistor $M_{402a}$, operating in deep triode, makes the small size but high value resistor, $R_{M402a}$, which helps in keeping the die size small while current at ultra low levels. The signal loop is also composed of amplifier $A_{400a}$ (consisting of $M_{404b}$-$M_{416a}$) with a built in offset determined by W/L ratios of $M_{404a}$ to $M_{406a}$ and $M_{410a}$ to $M_{408a}$, which are c and d, respectively. Input stage of $A_{400a}$ helps generate the PTAT term of about $V_T.\ln(cxd)$. The amplifier $A_{400a}$, substantially equalizes the $V_{DS}$ of $M_{402a}$ to the PTAT term of about $V_T.\ln(cxd)$. This is accomplished in part via forcing the gate voltages of transistors $M_{418a}$, which operate as a voltage controlled current source (VCCS) to bias $M_{402a}$ and $M_{400a}$ which set $R_{M402a}$ and whose operating current scales in proportion with $I_{TCa}$. The value of $R_{M402a}$ or $R_{BIAS\text{-}400a}$ is set in part by the $SC_{400a}$ composed of $M_{400a}$ and $M_{402a}$ scale factors and MOSFET's mobility which helps generate the CTAT term. The $I_{TCa}$ is made of $V_T.\ln(cxd)$ divided by $R_{M402a}$. Note that in FIG. 5, the scale factors 'a' through 'j' are the ratios of transistor's width over length (W/L or scale factors or aspect ratios) that may be set depending on such considerations as die size and various operating specifications, including but not limited to current consumption, temperature coefficients, and power supply range objectives. The scale factors 'a' through 'j' shown in FIG. 5 can be between approximately 0.1 and 50.

Secondly, and similar to the above description to $I_{TCb}$ generation, applying the same principle to the embodiment of FIG. 5, this is how current generator $I_{TCb}$ outputs a current with $TC_b$. The signal loop that generates $I_{TCb}$ includes $M_{402b}$, which makes the active CMOS resistor, $R_{M402b}$ (i.e., $R_{BIASb}$). The active transistor $M_{402b}$, operating in deep triode, makes the small size but high value resistor, $R_{M402b}$, which helps in keeping the die size small while current at ultra low levels. The signal loop is also composed of amplifier $A_{400b}$ (consisting of $M_{404b}$-$M_{416b}$) with a built in offset determined by W/L ratios of $M_{404b}$ to $M_{406b}$ and $M_{410b}$ to $M_{408b}$, which are f and g, respectively. Input stage of $A_{400b}$ helps generate the PTAT term of about $V_T.\ln(fxg)$. The amplifier $A_{400b}$, substantially equalizes the $V_{DS}$ of $M_{402b}$ to the PTAT term of about $V_T.\ln(fxg)$. This is accomplished in part via forcing the gate voltages of transistors $M_{418b}$, which operate as a voltage controlled current source (VCCS) to bias $M_{402b}$ and $M_{400b}$ which set $R_{M402b}$ and whose operating current scales in proportion with $I_{TCb}$. The value of $R_{M402b}$ or $R_{BIAS\text{-}400b}$ is set in part by the $SC_{400b}$ composed of $M_{400b}$ and $M_{402b}$ scale factors and MOSFET's mobility which helps generate the CTAT term. The $I_{TCb}$ is made of $V_T.\ln(fxg)$ divided by $R_{M402b}$.

Thirdly and lastly, the current $I_{TCb}$ is scaled and mirrored via $M_{418b}$ and $M_{420b}$ (by 1/h.X) and fed into $M_{422b}$ which is scaled (by j.X) and mirrored onto $M_{422a}$. Concurrently, the current $I_{TCa}$ is scaled and mirrored via $M_{418a}$ and $M_{420a}$ (by 1/e.X) and fed into drain of $M_{422a}$. Here the final $I_{REF}$ is generated which is a function of $K_{400b}\cdot I_{TCb}$-$S_{400}\cdot(K_{400a}\cdot I_{TCa})$, where $K_{400a}$, $K_{400b}$, $S_{400}$ are formulaic representations and approximately a function of MOSFET's W/L ratios and MOSFET's (device) fabrication process constants. Also note that other variations of this circuit topology knowable by those skilled in the art can include, but not limited to, for example generating $I_{TCb}$ using the prior art circuits such as the ones shown in FIG. 11 and FIG. 12, which is then scaled and subtracted from $I_{TCa}$ generated by this invention topologies (e.g., FIG. 1, or 2, or 3) to yield an $I_{REF}$.

The connections of the elements in FIG. 5 are described as follows. As noted earlier, node 1 is the positive supply voltage terminal or $V_{00}$. Similarly, node 2 is the negative supply voltage terminal or $V_{SS}$ (which can also be set as the zero voltage terminal or ground). The source and body terminals of $M_{414a}$, $M_{416a}$, $M_{418a}$, $M_{420b}$, and $M_{414b}$, $M_{416b}$, $M_{418b}$, $M_{420b}$ are connected to node 1, which is the positive power supply terminal. Note that $M_{414a}$ and $M_{414b}$ sets the bias voltage for the MOSFETs and $M_{416a}$, $M_{418a}$, $M_{420b}$, and $M_{416b}$, $M_{418b}$, $M_{420b}$, respectively. Here, $M_{414a}$, $M_{416a}$, $M_{418a}$, and $M_{420b}$ are current mirrors, as well as $M_{414b}$, $M_{416b}$, $M_{418b}$, and $M_{420b}$ all of which also function as current sources to set bias currents for $I_{TCa}$ and $I_{TCb}$ circuitries. The source and body terminals of $M_{408a}$, $M_{410a}$, $M_{412a}$, $M_{422a}$, and $M_{408b}$, $M_{410b}$, $M_{412b}$, $M_{422b}$ are connected to node 2, which is the negative or ground power supply terminal. Gates and drains of $M_{400a}$ and $M_{400b}$ (both of which is part of the self cascade circuits together with $M_{402a}$ and $M_{402b}$) are shorted to each other and connected to the node 2. Source and body of $M_{400b}$ are connected to drain of $M_{402b}$ and connected to node 402*b*, which is also connected to gate of $M_{406b}$. Source and body of $M_{402b}$ are connected to drain of $M_{418b}$ and gate of $M_{404b}$ and connected to node 400*b*. Source and body of $M_{404b}$, and source and body of $M_{406b}$ and drain of $M_{416b}$ are connected to node 406*b*. Drain of $M_{404b}$ and drain of $M_{408b}$ and gate of $M_{412b}$ are connected to node 408*b*. Gate and drain of $M_{410b}$ and drain of $M_{406b}$ are connected to node 410*b*. Drain of $M_{412b}$ and gate and drain of $M_{414b}$ are connected to node 404*b*. Gate terminals of $M_{416b}$, $M_{418b}$, and $M_{420b}$ are connected to node 404*b*. Drain of $M_{420b}$ and gate and drain terminals of $M_{422b}$ are connected to node 412*b*. Note that $M_{404b}$, $M_{406b}$, $M_{408b}$, $M_{410b}$, $M_{412b}$, and $M_{414b}$ form an amplifier ($A_{400b}$) with $M_{404b}$ and $M_{406b}$ gates at nodes 400*b* and 402*b* as $A_{400b}$'s input terminal and gate and drain of $M_{414b}$ as its output terminal. Also, as is the case with the FIG. 5 embodiment, note that offset voltage generation and amplifier function can be accomplished in one shot by scaling differing the sizes of $M_{404b}$, $M_{406b}$ and scaling differing currents through them via scaling differing the sizes $M_{408b}$ and $M_{410b}$.

Source and body of $M_{400a}$ are connected to drain of $M_{402a}$ and connected to node 402*a*, which is also connected to gate of $M_{406a}$. Source and body of $M_{402a}$ are connected to drain of $M_{418a}$ and gate of $M_{404a}$ and connected to node 400*a*. Source and body of $M_{404a}$, and source and body of $M_{406a}$ and drain of $M_{416a}$ are connected to node 406*a*. Drain of $M_{404a}$ and drain of $M_{408a}$ and gate of $M_{412a}$ are connected to node 408*a*. gate and drain of $M_{410a}$ and drain of $M_{406a}$ are connected to node 410*a*. Drain of $M_{412a}$ and gate and drain of $M_{414a}$ are connected to node 404*a*. Gate terminals of $M_{416a}$, $M_{418a}$, and $M_{420a}$ are connected to node 404*a*. Drain of $M_{420a}$ and gate and drain terminals of $M_{422a}$ are connected to node 412*a*, which is the $I_{REF}$ terminal. Note that $M_{404a}$, $M_{406a}$, $M_{408a}$, $M_{410a}$, $M_{412a}$, and $M_{414a}$ form an amplifier ($A_{400a}$) with $M_{404a}$ and $M_{406a}$ gates at nodes 400*a* and 402*a* as $A_{400a}$'s input terminal and gate and drain of $M_{414a}$ as its output terminal. Also, as is the case with the FIG. 5 embodiment, note that offset voltage generation and amplifier function can be accomplished in the amplifiers $A_{400a}$ (and $A_{400b}$) by scaling differing the sizes of $M_{404a}$, $M_{406a}$ and scaling differing currents through them via scaling differing the sizes $M_{408a}$ and $M_{410a}$ (as well as $M_{404b}$, $M_{406b}$ and scaling differing currents through them via scaling differing the sizes $M_{408b}$ and $M_{410b}$). Note also that transistor pairs $M_{402b}$-$M_{400b}$ and $M_{402b}$-$M_{400b}$ form the self cascades, $SC_{400a}$ and $SC_{400b}$, respectively where $R_{M402b}$ (or $R_{BIAS\text{-}400b}$) and $R_{M402a}$ (or $R_{BIAS\text{-}400a}$), play into the equation that sets the value of $I_{TCb}$ and $I_{TCa}$ currents.

Drain of $M_{420a}$ is connected to gate and drain of $M_{422b}$ as well as gate of $M_{422a}$ at node 412*b*. Drain of $M_{422a}$ and drain of $M_{420a}$ are connected to node 412*a*, as well as the $I_{REF}$ output terminal. Note that $M_{420a}$, $M_{422a}$, and $M_{420b}$, $M_{422b}$ constitute one of many possible embodiments (a simple one used here for descriptive simplicity and clarity) for the current scalar and subtractor function, but there are other higher performance variations of current scalar and subtractor function available and covered in prior art (e.g., Ledesma, F. et al, "Comparison of new and conventional low voltage current mirrors," Circuits and Systems, 2002. MWSCAS-2002, which is hereby incorporated by reference in its entirety).

In summary, current generator $I_{TCa}$ includes $M_{400a}$-$M_{418a}$, and current generator $I_{TCb}$ includes $M_{400b}$-$M_{418b}$, where $I_{TCa}$ and $I_{TCb}$ have differing TCs which are set by the circuit's MOSFET's scale factors (as well as a factor of MOSFET device parameter constants) so to generate an $I_{REF}$ with positive TC, or negative TC, or a near zero TC, which will be explained below.

Here is a more detailed explanation of the embodiment of FIG. 5. The circuit is composed of two current generator making $I_{TCa}$ and $I_{TCb}$ whose respective magnitude and TC can be set partially independently from one another so to be scaled and subtracted from each other to generate an $I_{REF}$ with near zero TC. Each current generator is composed of a CMOS amplifier ($A_{400a}$ and $A_{400b}$) and self-cascode ($SC_{400a}$ and $SC_{400b}$). Amplifier $A_{400a}$'s input includes $M_{404a}$, $M_{406a}$, $M_{408a}$, and $M_{410a}$ and has a built-in offset voltage roughly equal to $V_T.\ln(cxd)$ which is forced across $M_{402a}$ of $SC_{400a}$ (with its diode connected counterpart $M_{400a}$) so to generate a current $I_{TCa}$ via $M_{418a}$ that has a temperature coefficient of $TC_a$:

$$I_{TCa}=IDS_{M418a}=IDS_{M402a}=IDS_{M400a}=VDS_{M402a}/R_{M402a};$$

$$VGS_{M406a}-VGS_{M404a}\approx V_T.\ln(cxd)=VDS_{M402a};$$

$$R_{M402a}\approx[\mu.C_{OX}.(W/L)_{M402a}(VGS_{M402a}-V_{THp}-VDS_{M402a}/2)]^{-1};$$

$$VGS_{M402a}\approx[2I_{TCa}/\mu.C_{OX}.(W/L)_{M400a}]^{1/2}+V_{THp},$$

$$\mu.C_{OX}.(W/L)_{M402a}\times[I_{TCa}/\mu.C_{OX}.(W/L)_{M400a}]^{1/2}\approx I_{TCa}.[V_T.\ln(dxc)]^{-1}.$$

$I_{TCa}\approx f(K_{400a}, \mu, V_T)$, where $K_{400a}$ is set approximately by MOSFET's device parameter constants and the W/L sizes of MOSFETs in the $I_{TCa}$'s current generator circuitry.

Similar operations hold for the $A_{400b}$ and $SC_{400b}$ loops that generate the $I_{TCb}$. Amplifier $A_{400b}$'s input includes $M_{404b}$, $M_{406b}$, $M_{408b}$, $M_{410b}$ that has a built-in offset voltage roughly equal to $V_T.\ln(fxg)$ which is forced across $M_{402b}$ of $SC_{400b}$ (with its diode connected counterpart $M_{400b}$) so to generate a current $I_{TCa}$ via $M_{418a}$ that has a temperature coefficient of $TC_b$:

$$I_{TCb}=IDS_{M418b}=IDS_{M402b}=IDS_{M400b}=VDS_{M402b}/R_{M402b};$$

$$VGS_{M406b}-VGS_{M404b}\approx V_T.\ln(g\times f)=VDS_{M402b};$$

$$R_{M402b}\approx[\mu.C_{OX}.(W/L)_{M402b}(VGS_{M402b}-V_{THp}-VDS_{M402b}/2)]^{-1};$$

$$VGS_{M402b}\approx[2I_{TCb}\mu.C_{OX}.(W/L)_{M400b}]^{1/2}+V_{THp};$$

$$\mu.C_{OX}.(W/L)_{M402b}\times[I_{TCb}/\mu.C_{OX}.(W/L)_{M400b}]^{1/2}\approx I_{TCb}.[V_T.\ln(g\times f)]^{-1};$$

$$I_{TCb}\approx f(K_{400b},\mu,V_T),$$

where $K_{400b}$ is set approximately by the W/L sizes of MOSFETs in the $I_{TCb}$'s current generator circuitry;

In the current scalar and subtractor circuit there is: $I_{REF}=K_{400b}.\ I_{TCb}-S_{400}.\ (K_{400a}\ I_{TCa})$. As noted earlier, If a near zero TC current reference ($I_{REF}$), then magnitude of $I_{TCa}$ can be scaled with MOSFET's W/L ratios such that a current $S_{400}.\ (K_{400a}.\ I_{TCa})$ whose value changes near equally to that of $K_{400b}\ I_{TCb}$ over an objective temperature range.

In the embodiment of FIG. 5, similar to the embodiment of FIG. 4, it can be noticed in the $I_{TCa}$ and $I_{TCb}$ equations that $V_{TH}$ term is canceled out in both the first loop ($M_{404a}$, $M_{406a}$ as well as $M_{404b}$, $M_{406b}$) and the second loop ($M_{400a}$, $M_{402a}$ as well as $M_{400b}$, $M_{402b}$) which desensitizes $I_{TCa}$ and $I_{TCb}$ value from $V_{TH}$ variations in process fabrication. As it is the case with this class of current sources, $I_{TCa}$ and $I_{TCb}$, and thereby $I_{REF}$ which is a byproduct of them to be primarily a function of $C_{OX}$, $V_T$, and μ. Here $C_{OX}$ is a function of gate oxide thickness which has a very low TC, $V_T$ has a positive TC (PTAT like) and u has a negative TC (CTAT like). Therefore, the TC of $I_{TCA}$ and $I_{TCB}$ (and hence TC of $I_{REF}$ which is a function $I_{TCA}$ and $I_{TCB}$) can be positive or negative or approximately flat depending on $S_{400}$, $K_{400a}$, and $K_{400b}$ which are predetermined or programmed (depending on circuit need) by the MOSFET device constants, and W/L sizes by setting scale factors 'a' through 'j', in FIG. 5. Note also that other variations of the proposed topology could include, but not be limited to, operating MOSFETs in $SC_{400a}$ and $SC_{400b}$ at different scaled currents (instead of PMOS), utilizing NMOS self-cascode or conventional current mirrors (triode MOS plus saturation diode connected MOS), or using source followers or diode level shifters or NMOS input (instead of PMOS) $A_{400a}$ and $A_{400b}$ with built-in offset voltages in order to achieve different specifications trades-offs (e.g., sub-1V operations).

In this section some of the benefits of the embodiment depicted in FIG. 5 are described: as noted earlier, typical reference topologies add two currents with opposing TC polarities to generate a stable TC current reference, whereas this reference generates two currents ($I_{TCa}$ and $I_{TCb}$) with same polarity TCs that are scaled with differing slopes, and subsequently scaled and subtracted from each other to form a very stable TC $I_{REF}$ which provides a the benefit of more flexibility in generating $I_{REF}$ with different amplitude and TC. One of these flexibilities includes, but not limited to, programming an $I_{REF}$ with wider range of positive, negative, or very stable TC.

Also, while adhering to matching considerations by using the same exact narrow W and long L in the two independent self cascades ($SC_{400a}$ and $SC_{400b}$), the TC and magnitude of $I_{TCa}$ and $I_{TCb}$ can be programmed differently via (mostly by) setting the ratio of W/Ls of MOSFETs aspect ratios, which can be made accurate with respect to topology targets because they are most independent of fabrication process variation.

In effect, the embodiment of FIG. 5 uses substantially similar functional blocks of the embodiment of FIG. 2 two times. Using different MOSFET aspect ratios (which are tightly controllable in process), the first instance of bias current generation (i.e., $I_{TCa}$) produces certain amplitude and TC that is different from that of the one produced in the second instance of bias current generation (i.e., $I_{TCb}$), while both $I_{TCa}$ and $I_{TCb}$ are subject to the same process fabrication, power supply, and temperature variations. As such, an advantage of the embodiment of FIG. 5 is to generate $I_{TCa}$ and $I_{TCb}$ by using the same configuration and same CMOS W/Ls in amplifiers ($A_{400a}$ and $A_{400b}$), same CMOS W/Ls in self cascades ($SC_{400}$, and $SC_{400b}$), and same CMOS W/Ls in current mirrors ($VCCS_{400a}$ and $VCCS_{400b}$). And because of this, the second order errors due to process, temperature, and power supply variations track each other and some of them are cancelled out, which helps both DC and AC performance of the current reference.

Similar to the embodiment of FIG. 4, for this embodiment of FIG. 5, the $V_{PTAT}$ is sensed and current is forced across an active resistor, $R_{M4002a}$ and $R_{M402b}$, at the gate terminal instead of the prior art that does it at the source terminal of the current mirror loop amplifier. However, the embodiment of FIG. 4 used an NMOS resistor, an independent PMOS source follower (i.e., unity gain buffer with a built in offset voltage as a function of pseudo $V_T$) function for built offset voltage (or $V_{PTAT}$) generation, and a separate loop amplifier function for amplification. Instead, here in FIG. 5, the function of built in offset voltage (or $V_{PTAT}$) generation and amplification are both preformed in MOS amplifiers which save some area and current, where additionally both active MOSFET resistors and MOSFET amplifier inputs are of the same type (i.e., PMOS) enabling better fabrication process tracking and lower noise (since PMOS has lower noise than NMOS).

As just noted for the embodiment of FIG. 5, the sensing and forcing of signal takes place at the gate terminal instead of the prior art that does it at the source terminal. As a result, another benefit of this embodiment is that one input of the loop amplifier is biased via an MOS that is diode connected (gate and source shorted) in SC and the other input of the loop amplifier is biased via the other MOS in SC that (is the resistor and sets the operating current) is in the feedback loop of the amplifier. As a consequence, the active MOS impedance (e.g., $R_{BIASa,b}$) is lowered by the gain of the current mirror loop or current loop amplifier. Also, beside improvements in AC performance due to lower impedance here, the junction leakage asymmetries associated with generation of $V_T$ (in prior art implementations) are also separated from the SC operation, which helps wider temperature span (e.g., improving 0-70 C temperature span to 0-100 C) of this embodiment.

Moreover, embodiment of FIG. 5 is benefited for less dependence on process parameter variation because it eliminates some of the second order device's second order effects, including but not limited to, for example the elimination of NMOS body effect in $M_{200}$ that was present in the embodiment of FIG. 4. Also, keeping the benefits of the category of circuits to which it belongs, the embodiment of FIG. 5 is substantially independent of $V_{TH}$ and mostly depended on μ, which is better controlled in process fabrication, hence the overall power consumption of the current reference is more tightly controlled over process variations. Also, the embodiment of FIG. 5 can operate MOSFET in the subthreshold region, which enables low power supply and ultra low power consumption. Another benefit of the FIG. 5 embodiment is that $V_{SS}$ (negative power supply) and the ground potential (GND) may be the same of separated, providing flexibility to system topology, which allows $I_{TCa}$, $I_{TCb}$ and $I_{REF}$ to be set in value independent of the ground potential.

Figure 6:
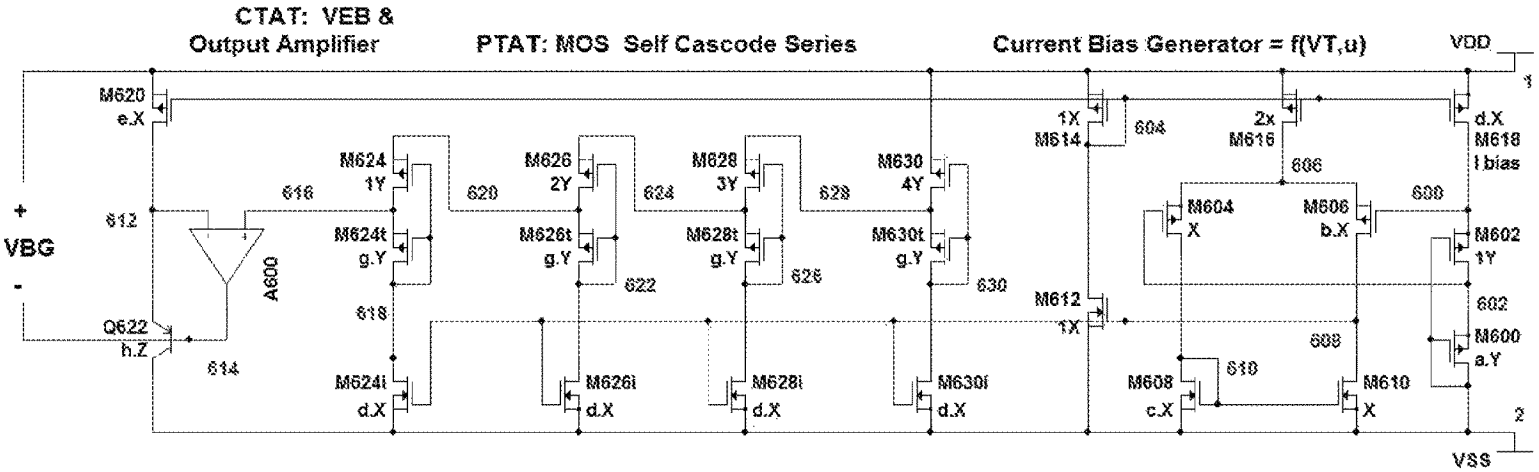
FIG. 6 is a schematic circuit diagram of the embodiment illustrating a voltage reference, or regulator, or bandgap voltage utilizing FIG. 2.

Description of the FIG. 6 Embodiment in a 'Voltage Reference'

The embodiment shown in FIG. 5 is utilized in the embodiment depicted in FIG. 6, which is a 'voltage reference' that can also generate a pseudo bandgap reference voltage. This third embodiment in FIG. 6 includes elements such as amplifiers. The amplifier is defined here broadly, which could be a voltage output or current output, or have voltage output combined with voltage controlled current source or VCCS. Such an amplifier, could also contain differential buffers (e.g., differential source followers, DC level shifters, voltage offset generators in series with its differential inputs). Other elements contained here could be a voltage buffer or followers or DC level shifters, voltage offset generators, current mirrors, voltage controlled current source (VCCS), self-cascodes, and MOSFETs (e.g., MOS transistors can be configured to function as a VCCS, current mirror, current sources or an active resistors or MOSFETs that can be paired in the input of an amplifier or buffer or DC level shifter—with differing scale factors—to generate offset voltage).

The embodiment in FIG. 6 is a voltage reference, which includes current bias generator section or $I_{BIAS}$ section, MOS self cascode (SC) series section (that sums a number $V_{PTAT}$s to establish the PTAT term of the voltage reference), and $V_{BE}$ generator (that establishes the CTAT term) combined with an output voltage amplifier section, yielding the voltage reference output, $V_{REF}$. The embodiment of FIG. 6 may be used to make a low cost (small die size), ultra low power, resistor free, CMOS pseudo bandgap voltage reference, where by programming or predetermining MOSFET's W/L sizes or ratios, an $V_{REF}$ equal to bandgap voltage (about 1.2V) of $V_{BG}$ with a stable TC may be realized. Different adjustments in MOSFET aspect ratios in this topology also allows for the option of generating a $V_{REF}$ that exhibits positive or negative TC.

Here is a description of the embodiment of FIG. 6 and some of its benefits. The proposed circuit belongs to a class of resistor free bandgap voltage references ($V_{REF}$ or $V_{BG}$) whose CTAT voltage ($V_{CTAT}$) is generated by $V_{EB}$ of a parasitic BJT available in standard CMOS fabrication process. This reference's PTAT voltage $V_{PTAT}$ is generated via summation, where the PTAT term is generated by adding K of the $V_T$.ln (g) terms that are generated via K plurality of scaled MOS self-cascodes (SC) whose each of resistive MOSFET's source-drain terminals are in series with one another while they all operate in subthreshold. All the SCs are concurrently biased by the bias current circuit of that is the embodiment of functional block diagram depicted in FIG. 2. Here K is the number of SC put in series with one another in the PTAT segment of the circuit. The embodiment of FIG. 6 shows K=4, but K can be a number as low as 2 or as high as 20. This circuit's contributions may include the following. The topology employs SCs in a manner to generate both the bandgap's $I_{BIAS}$ and $V_{PTAT}$ segments of the circuitry so that their operating conditions track over power supply, temperature, and supply variations, thereby aiding $V_{REF}$'s specifications. AC, transient performances are benefited because $V_{PTAT}$ and $V_{CTAT}$ signal paths are made in independent signal paths from one another, avoiding the simultaneous positive and negative $V_{PTAT}$ loops inherent in conventional bandgaps. Also, the die yield, attributed to impact of random non-ideal terms in the $V_{PTAT}$'s signal path, is comparatively attenuated since $V_{PTAT}$ is generated via summation instead of the multiplication that is operant in conventional bandgaps.

Operating in subthreshold, the MOS bias current generator segment includes the SC's $M_{602}$ and $M_{600}$. In the bias current generator segment of FIG. 6, by utilizing the built in offset voltage of $V_{PTAT}$~$V_T$.ln (bxc) that is set by scaling $M_{604}$-$M_{606}$ and $M_{608}$-$M_{610}$ within the bias amplifier $A_{602}$ (composed of $M_{604}$, $M_{606}$, $M_{608}$, $M_{610}$, $M_{612}$, $M_{614}$, and $M_{616}$), a $V_{PTAT}$ is forced across $VDS_{M602}$. Note that $I_{BIAS}$ flowing through the bias current generator's SC ($M_{600}$-$M_{602}$) is also fed into the SC series of the PTAT segment of the $V_{REF}$ circuit ($M_i$-$M_{it}$ where 'i' is even numbers 624 to 630, such as $M_{626}$-$M_{626t}$ or $M_{624}$-$M_{624t}$). It is of note that $I_{BIAS}$ can be configured such that its operating currents can be set to have a positive, negative, or near zero TC, depending on $V_{REF}$ circuit performance requirements and process parameters. Similar to $I_{BIAS}$ generation of FIG. 4 and that of FIG. 5, here in embodiment of FIG. 6 the $I_{BIAS}$ value over fabrication process variations is primarily a function of $V_T$ and μ (mobility of MOSFETs) and not $V_{TH}$. Here the TC of $I_{BIAS}$ operating conditions which employs SC, mimics a similar mechanisms in the chain of SCs ($M_i$-$M_{it}$ SCs) used in the PTAT section. The W/L of MOSFETs in the chain of SCs of the $V_{PTAT}$ section and in the SC of the $I_{BIAS}$ section may be made identical. Since $I_{BIAS}$ that is fed to SCs of the $V_{PTAT}$ section ($M_{624}$, $M_{626}$, $M_{628}$, and $M_{630}$) is mirrored from the $I_{BIAS}$ that resulted from forcing a PTAT voltage or ~$V_T$.ln (bxc) across SC in the bias circuit ($V_{DS}$ of $M_{602}$), therefore a (multiple or fraction of) PTAT voltage can be developed across the drain to source terminals of each of the resistive MOSFETs $M_{624}$, $M_{626}$, $M_{628}$, and $M_{630}$ of SCs of the cumulative $V_{PTAT}$ section. A voltage reference output or $V_{REF}$, with respect to $V_{DD}$ is hence generated via the summation (series combination or accumulation) of each of such PTAT voltages developed across drain to source terminals of each of the resistive MOSFETs of series of SCs, whose cumulative voltage (e.g., K×$V_{PTAT}$) is subsequently added to a $V_{CTAT}$, generated via the BJT $Q_{622}$, which is configured in unity gain with a DC shift of $V_{BE}$.

Note that in FIG. 6, the scale factors 'a' through 'h' are the ratios of transistor's width over length (W/L or scale factors or aspect ratios) that may be set depending on such considerations as die size and various operating specifications, including but not limited to current consumption, temperature coefficients, and power supply range objectives. The scale factors 'a' through 'h' can be in the range of approximately 0.1 to approximately 50.

The connections of the elements in FIG. 6 are described as follows. Similar to the bias current generators utilized in FIGS. 5 and 6, the embodiment in FIG. 6 also employs a bias current generator. Node 1 is the positive power supply, $V_{DD}$, which is connected to the following terminals: source and body of $M_{618}$, source and body of $M_{616}$, source and body of $M_{614}$, source and body of $M_{630}$, and source and body of $M_{620}$. Node 2 is the negative power supply, $V_{SS}$, which can also be the ground potential depending on system requirements. Node 2 is connected to the following terminals: gate of $M_{602}$, gate and drain of $M_{600}$, body and source of $M_{610}$, body and source of $M_{608}$, body and source of $M_{612}$, body and source of $M_{630i}$, body and source of $M_{628i}$, body and source of $M_{626i}$, body and source of $M_{624i}$, and collector of $Q_{622}$.

In the current bias generator section, which biases up the voltage reference, the source and body of $M_{600}$ are connected to drain of $M_{602}$ and connected to node 602, which is also connected to gate of $M_{604}$. Source and body of $M_{602}$ are connected to drain of $M_{618}$ and gate of $M_{606}$ and connected to node 600. Source and body of $M_{604}$, and source and body of $M_{606}$ and drain of $M_{616}$ are connected to node 606. Drain of $M_{606}$ and drain of $M_{610}$ and gate of $M_{612}$ are connected to node 608. Gate and drain of $M_{608}$ and drain of $M_{604}$ are connected to node 610. Drain of $M_{612}$ and gate and drain of $M_{614}$ are connected to node 604. Gate terminals of $M_{616}$, $M_{618}$, and $M_{620}$ are connected to node 604. Note that $M_{604}$, $M_{606}$, $M_{608}$, $M_{610}$, $M_{612}$, and $M_{614}$ form a voltage amplifier ($A_{602}$) with $M_{604}$ and $M_{606}$ gates at nodes 600 and 602 as $A_{602}$'s input terminal, and gate and drain of $M_{614}$ as the amplifier output terminal. Also, similar to the embodiment of FIG. 5, in the embodiment of FIG. 6 note that offset voltage generation and amplifier function can be accomplished in one shot by scaling differing the sizes of $M_{604}$ $M_{606}$ and scaling differing currents through them via scaling differing the sizes $M_{608}$ and $M_{610}$. MOSFETs $M_{614}$, $M_{616}$, $M_{618}$, and $M_{620}$ form current mirrors whose value is scaled via 'd' with respect to the bias level established by $M_{614}$, and here also $M_{618}$ functions as the $VCCS_{600}$ that feeds the bias current for the self cascode ($SC_{600}$) composed of $M_{602}$ and $M_{600}$.

The PTAT signal (with respect to $V_{DD}$) is generated via a series of MOS SCs, whose node's connectivity is as follows: node 628 is connected to drain of $M_{630}$ and to the body and source of $M_{630t}$ and to the source and body of $M_{628}$. Node 624 is connected to drain of $M_{628}$ and to the body and source of $M_{628t}$ and to the source and body of $M_{626}$. Node 620 is connected to drain of $M_{626}$ and to the body and source of $M_{626t}$ and to the source and body of $M_{624}$. Node 616 is connected to drain of $M_{624}$ and to the body and source of $M_{624t}$ and to the positive input terminal of output amplifier, $A_{600}$. Node 630 is connected to gate of $M_{630}$ and gate plus drain of $M_{630t}$ and drain of $M_{630i}$; Node 626 is connected to gate of $M_{628}$ and gate plus drain of $M_{628t}$ and drain of $M_{628i}$; Node 622 is connected to gate of $M_{626}$ and gate plus drain of $M_{626t}$ and drain of $M_{626i}$; Node 618 is connected to gate of $M_{624}$ and gate plus drain of $M_{624t}$ and drain of $M_{624i}$. Gates of $M_{630i}$, $M_{628i}$, $M_{626i}$, and $M_{624i}$ are connected to gate of $M_{612}$ at note 608. In FIG. 602, the MOSFET pairs whose W/L's are scaled by the ratio 'g' are $M_{624}$-$M_{624t}$, $M_{626}$-$M_{626t}$, $M_{628}$-$M_{628t}$, and $M_{630}$-$M_{630t}$ make the self cascode $SC_{600}$, $SC_{602}$, $SC_{604}$, and $SC_{606}$, respectively. $M_{630i}$, $M_{628i}$, $M_{626i}$, and $M_{624i}$ provide the bias current for the SCs whose currents are mirrors of one another and are scaled by 'd' biased via $M_{612}$ (from the bias generation section). Note that for ease and clarity of describing the embodiment of FIG. 6, only four SCs are shown. But the SC series could contain different number of SCs and bias currents (e.g., between 2 to 12) depending on fabrication process and $V_{REF}$'s specification requirements. Moreover and also for demonstrative clarity a simple current bias and mirror circuitry is shown in FIG. 6. But bias current circuits could be looped differently and or cascoded (e.g., desensitize the impact of MOS's $V_A$) to improve bandgap's specifications, including but not limited to its' VC. The CTAT signal generation in FIG. 6 containing the $V_{EB}$ DC level shift and output amplifier section has the following nodes: node 612 is connected to the negative terminal of $A_{600}$ which is also connected to emitter of $Q_{622}$ and drain of $M_{620}$. Output of $A_{600}$ is connected to node 614 which is also connected to the base of $Q_{622}$.

The following is a more detailed description of FIG. 6. $V_{BG}$ is composed on $V_{PTAT}$ with a positive TC and $V_{CTAT}$ with a negative TC whose addition generates a near zero TC output voltage of $V_{BG}$. The $V_{PTAT}$ generator is made by K series of SC PMOSFETs, $M_i$-$M_{it}$ (also operating in the subthreshold region) sized with '1/g' ratio. The SC's PMOSFETs generate $K\times[V_T.\ \ln(g)+V_e]$. Here $V_e$ is approximated as the average DC equivalent of error terms (i.e., offset, drift, noise, etc) in the $V_{PTAT}$ signal path. The random contribution of $V_e$ to die yield should be roughly the square root of sum of $V_e^e$ or about $K^{1/2}$.Ve versus for conventional bandgaps where $V_e$ equivalent term (dominated by the PTAT loop amplifier) is multiplied by PTAT loop gain or about K. $V_e$. The bandgap's CTAT is generated by $V_{EB}$ of parasitic vPNP with $Q_{622}$ that DC shifts the output of the unity gain amplifier. The bandgap voltage $V_{BG}$ accounting for random impact of $V_e$ to yield, is about: $V_{BG}\sim V_{EB}+K.[V_T.\ln(g)+(K^{1/2}+1)\times V_e]$.

As noted earlier in this section, the embodiment in FIG. 6 employs SCs in a manner to generate both the bandgap's $I_{BIAS}$ and $V_{PTAT}$ circuitry so that their operating conditions track over power supply, temperature, and supply variations, thereby aiding bandgap's specifications. Hence similar to the embodiments in FIGS. 4 and 5, here in FIG. 6 there is the first voltage loop consisting of $M_{602}$, $M_{604}$, $A_{602}$, and $M_{606}$ produce a PTAT signal as a function of $V_T$ which is forced upon the $V_{DS}$ of $M_{602}$ by the operation of the loop. There is also a second voltage loop consisting of $M_{600}$ and $M_{602}$ where $M_{600}$ operates in saturation and $M_{602}$ operates in the triode region (i.e., that is acting as an active resistor of $R_{M602}=R_{BIAS}$ for this current source). This active resistor, while functioning as the current source's resistor, contributes to a CTAT signal into the $I_{BIAS}$ being mostly a function of μ. In the bias section, the application of PTAT signal via $V_T$ while interacting with CTAT signal via μ enables setting the objective TC (positive, negative, or neutral, or in between them) for $I_{BIAS}$. This same $I_{BIAS}$ is applied to the SC series. Note that for demonstrative clarity of the proceeding formulations, second order effects—including but not limited to—early voltage, body effect, subthreshold slope factor TC are ignored:

$$VGS_{M602}-VGS_{M600}=VDS_{M602};$$

$$R_{BIAS}=R_{M602}\approx[\mu.C_{OX}.(W/L)_{M602}(VGS_{M602}-V_{THp}-VDS_{M602}/2)]^{-1};$$

$$VGS_{M602}\approx[2I_{BIAS}/\mu.C_{OX}.(W/L)_{M600}]^{1/2}+V_{THp};$$

$$VGS_{M604}-VGS_{M606}=[V_T.\ln(cxb)]=VDS_{M602};\text{ and}$$

$$\mu.C_{OX}.(W/L)_{M602}\times[I_{BIAS}/\mu.C_{OX}.(W/L)_{M600}]^{1/2}\approx I_{BIAS}.[V_T.\ln(cxb)]^{-1};$$

$$I_{BIAS}\approx f(S_{600},\mu,V_T).$$

As just noted above, this same $I_{BIAS}$ is applied to the SC series, where:

$$VDS_{M630}=VGS_{M630}-VGS_{M630t};$$

$$VDS_{M628}=VGS_{M628}-VGS_{M628t};$$

$$VDS_{M626}=VGS_{M626}-VGS_{M626t};\text{ and}$$

$$VDS_{M624}=VGS_{M24}-VGS_{M624t}.$$

Given that the bias circuit employs a similar mechanism (i.e., $VGS_{M602}-VGS_{M600}=VDS_{M602}$) to generate both the bandgap's $I_{BIAS}$ and $V_{PTAT}$ sections, hence their operating conditions track over power supply, temperature, and supply variations, thereby aiding bandgap's specifications.

Before turning to more details about the benefits of the FIG. 6 embodiment, it can be noticed that $V_{TH}$ term is canceled out in both the first loop ($M_{604}$, $A_{602}$, $M_{606}$) and the second loop ($M_{600}$, $M_{602}$) as well as in the SC series ($M_{630}$-$M_{630t}$, $M_{628}$-$M_{628t}$, $M_{626}$-$M_{626t}$, and $M_{624}$-$M_{624t}$) which desensitizes $I_{BIAS}$ and the $V_{PTAT}$ terms (as well as the $V_{REF}$ or $V_{BG}$) from $V_{TH}$ variations in process fabrication.

Some of the benefits of the embodiment of FIG. 6 are summarized here. First, low cost due to small die size with no passive resistor in standard digital CMOS fabrication with ease of process node portability besides smaller die size keeping the cost low. Moreover, in order to serve some of the medical applications of this topology, a very small die size is necessary for small incisions (e.g., or inside a crown). Second, ultra low power consumption over temperature span. Ultra low current consumption is key in some applications for example because replacement of micro-batteries or use of noisy magnetic micro-harvesters for power transfers may be impractical or unsafe. Third, superior VC, PSRR, and transient performance. For example, there could be mission critical biomedical batteryless systems may require uninterrupted monitoring and measurements while the IC's power supply is being charged via multiple micro-harvesters or being subjected to disorderly patterns. Fourth, avoiding big decoupling capacitors may be key for voltage references in some applications. For example, a large decoupling capacitor (typically isolated from power storage super-capacitor with a Schottky diode) can burden the scarce power of micro-energy harvester reserves, especially during power up and power down transients. As such, a voltage references such as the embodiment in FIG. 6 with superior VC, PSRR, and AC performance (or requiring much smaller decoupling capacitors) can be significantly more critical for micro-energy harvesting ICs. Fifth, another benefit of the FIG. 602 embodiment is that $V_{SS}$ (negative power supply) and the ground potential (GND) may be the same of separated, providing some flexibility to system topology. Sixth, also note that a challenge with ultra low current and MOSFETs is high noise. Apples-to-apples the embodiment of FIG. 6 is architecturally equipped to enhance noise performance compared to prior art because: (a) as noted above, the contribution of noise within the $V_{PTAT}$ generation circuit is (noise)×$K^{1/2}$ because of the operation of summation instead of multiplication in the conventional bandgap of FIG. 2 where operation of multiplication or K (noise)×K gains up the loop amplifier A1's noise; (b) PMOSFET SCs may be used to build up to the $V_{PTAT}$ along the SC string, PMOSFETs may be used in the SC and the amplifier of the bias current generation circuit, as well as in the output amplifier differential input pairs, which should reduce the contribution of 1/f noise to the $V_{BG}$ output; and (c) bandgap reference's noise can be materially band pass filtered out by placing a capacitor at the end of the SC string or the high impedance node of output amplifier but in accordance with consideration for power up and down settling time requirements.

In addition to the synthesis of the aforementioned contributions of the embodiment of FIG. 6, as noted earlier, aims to improve upon the broader benefits attributable to the category of bandgap references to which it belongs. Some of such benefits are: (1) the PTAT and CTAT signal paths are independent, and hence the positive and negative feedback loops inherent in conventional bandgap PTAT loops are avoided, thus helping transient and power-up and down responses of the bandgap; (2) the non-idealities attributed to random DC offsets and noise that impact $V_{BG}$ are attenuated, due to operations of summation compared to multiplication for conventional bandgaps; and (3) tight performance tolerance over standard CMOS manufacturing process variations. Bandgap's $I_{BIAS}$ is made independent of CMOS $V_{TH}$ and instead primarily depends on $V_T$ and μ, which is more tightly controllable in manufacturing.

Figure 7:
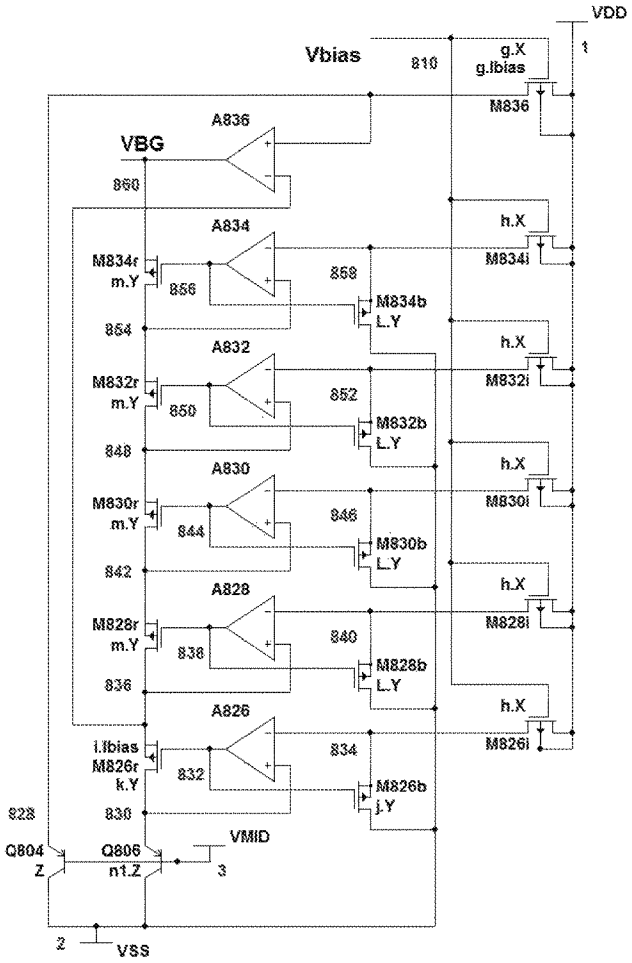
FIG. 7 is a schematic circuit diagram of the embodiment illustrating a bandgap voltage reference or regulator utilizing FIGS. 3, 8, and 9.
Figure 8:
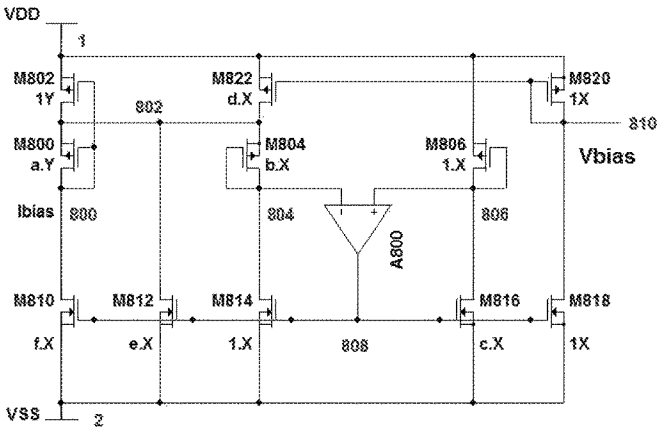
FIG. 8 is a schematic circuit diagram of the embodiment illustrating a bias current source, regulator, or generator utilized in embodiment of FIG. 7.
Figure 9:
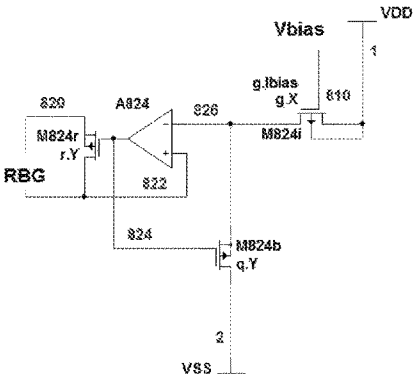
FIG. 9 is a schematic circuit diagram of the embodiment illustrating an active MOS resistor, a composite active MOS resistor or MOS resistor utilized in embodiment of FIG. 7 in conjunction with embodiment of FIG. 8.

Description of the FIG. 9 Embodiment in a Bandgap Voltage Reference Along with FIGS. 3, 7, and 8

This fourth embodiment shown in FIG. 7, along with FIGS. 3, 8, and 9, includes elements such as amplifiers. The amplifier is defined here broadly, which could be a voltage output or current output, or have voltage output combined with voltage controlled current source or VCCS. Such an amplifier, could also contain differential buffers (e.g., differential source followers, DC level shifters, voltage offset generators in series with its differential inputs). Other elements contained here could be voltage buffer or followers or DC level shifters, voltage offset generators, current sources, current mirrors, voltage controlled current sources (VCCS), self-cascodes, bipolar transistors or BJTs (including parasitic vertical BJT) and MOSFETs (e.g., MOS transistors can be configured to function as an active resistor, or a VCCS, current mirror, current sources or MOSFETs that can be paired in the input of an amplifier or buffer or DC level shifter—with differing scale factors—to generate offset voltage).

The embodiment in FIG. 7 is a voltage reference, which consists of current bias generator $I_{BIAS}$, MOS active resistors (that establishes the PTAT signal in the bandgap), and $V_{EB}$ generator (that establishes the CTAT signal in the bandgap) plus output amplifier delivering the voltage reference output, $V_{REF}$ or $V_{BG}$.

The goal here is for the functional block shown in FIG. 3 to be used in an embodiment of a bandgap voltage reference depicted in FIG. 7 so as to make an ultra low power, resistor free, CMOS bandgap voltage reference. By setting MOSFET's W/L ratios in FIG. 7, a $V_{REF}$ equal to bandgap voltage (about 1.2V) or $V_{BG}$ with a stable TC may be realized, although a $V_{REF}$ with positive, or negative TC is possible with the topology.

Figure 10:
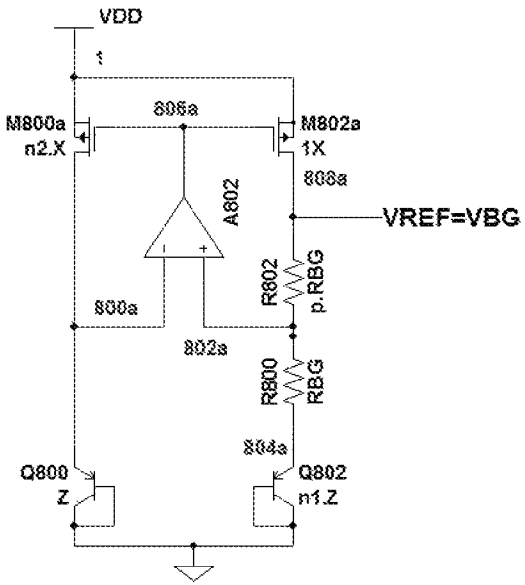
Prior Art Figure 10
FIG. 10 is a schematic circuit diagram of an embodiment illustrating a prior art bandgap voltage reference.

Here is a summary description and some of the benefits of the embodiment of FIG. 7. The proposed circuit belongs to a conventional class of bandgap voltage references that adds a PTAT and a CTAT signal to yield a near zero TC, as depicted in prior art FIG. 10. In FIG. 10, a $V_{PTAT}$ (as a multiple of $V_T$) signal is placed across $R_{800}$ (or $R_{BG}$). As a consequence, the current through $R_{BG}$ flows through $R_{802}$ (p.$R_{BG}$), which amplifies the $V_{PTAT}$ such that the sum of $VEB_{Q802}$ (which is the CTAT signal) and [p+1]×$V_{PTAT}$ yields the $V_{REF}$ or $V_{BG}$ with a stable TC. Conventional bandgap voltage reference, such as the one shown in FIG. 10, can be attractive because for high volume markets, bandgap voltage references may be viewed in a more favorable light in manufacturing due to the predictable $V_{BE}$ and $V_T$ terms that constitute the $V_{BG}$.

However, prior arts bandgaps of this category require passive resistors (e.g., $R_{800}$ and $R_{802}$), which makes their implementation in small form factor, low-cost, and ultra low power applications, such as energy harvesting impossible or impractical. Therefore, a resistorless CMOS bandgap embodied of FIG. 7 employs the bias current generator (functional block shown in FIG. 3) that is utilized in FIG. 8.

A new composite active MOS resistor is proposed, depicted in FIG. 9, which has a small size and high resistance. A network of active resistors using this composite active resistor cell (FIG. 9) replace the function of $R_{GB}$ for $R_{800}$ plus 'p' times of $R_{GB}$ for $R_{802}$. The composite active resistor of FIG. 9, working in concert with the bias current circuit of FIG. 804, is embodied in the bandgap circuit (FIG. 7).

The bias circuit of FIG. 8, makes possible the creation of the active resistor (FIG. 9), which enables keeping both the reliability benefits of conventional bandgap topology as well as eliminating the bandgap's need for passive resistors, which consequently enables making an ultra low power bandgap of FIG. 7 possible in standard digital CMOS. In the $I_{BIAS}$ generator of FIG. 8, a $V_{PTAT}$ (in the $M_{804}$-$A_{800}$-$M_{806}$ loop making VT.ln [bxc]) is forced upon the active resistors $R_{M802}$. Similarly, in the bandgap voltage reference circuit of FIG. 7, a $V_{PTAT}$ (in the $Q_{804}$-$A_{800}$-$Q_{806}$ loop making VT.ln [gxi])]) is forced upon the active resistors $R_{M826r}$. The $I_{BIAS}$ generator circuit of FIG. 8 and the bandgap loop circuitries of FIG. 7 independently apply PTAT voltages across functionally similar composite MOS resistors, namely $R_{M802}$ and $R_{M826r}$ to generate their respective operating currents $ID_{M802}$ and $ID_{M826r}$.

Note also that in the SC loop in the $I_{BIAS}$ generator circuit of FIG. 8, $VGS_{M800}-VGS_{M802}=VDS_{M802}$, where $M_{802}$ is the MOS resistor of $I_{BIAS}$ circuit. Similarly, note that in the active MOS resistor of FIG. 9, ignoring the $V_{OFFSET}$ of amplifier $A_{824}$ for now, $VGS_{M824b}-VGS_{M824r}=VDS_{M824r}$, where $M_{824r}$ is the MOS resistor of active resistor circuit. This topology uses substantially similar functional conditions between the operations of $M_{802}$-$M_{800}$ loop in the $I_{BIAS}$ generator circuit of FIG. 8, and that of each of the MOS resistors of FIG. 9 that is utilized in the bandgap circuit of FIG. 7 (i.e., $M_{826b}$-$A_{826}$-$M_{826r}$ loop, $M_{828b}$-$A_{828}$-$M_{828r}$ loop, $M_{830b}$-$A_{830}$-$M_{830r}$ loop, $M_{834b}$-$A_{834}$-$M_{836r}$ loop). Therefore, the operating conditions of the $I_{BIAS}$ generator of FIG. 8, the active MOS resistor of FIG. 9, and bandgap circuit of FIG. 7 substantially track each other over fabrication process and temperature and power supply variations, and able to approximate a PTAT like behavior over temperature.

The combination of the $I_{BIAS}$ generator of FIG. 8, the active MOS resistor of FIG. 9, and bandgap circuit of FIG. 7 enable the bandgap's power consumption to be mostly independent of MOSFET's $V_{TH}$ and chiefly a function of mobility, μ, that benefits manufacturability and yield because μ, is more tightly controllable (compared to poly resistance or $V_{TH}$, for example). Such trait not only yields a more stable bandgap voltage reference, but also one that delivers ultra low power which has a narrower range of variation over temperature and fabrication process corners.

Another advantage of combining $I_{BIAS}$ generator of FIG. 8, the active MOS resistor of FIG. 9, and bandgap circuit of FIG. 7, is that the bandgap circuit can be more stable in AC and transient response. For example, wireless and battery-less electronic systems, in general, may be subject to less orderly power supply patterns. To guard band against disorderly power supply and start-up patterns, especially for instance in mission critical bioelectronics applications, the positive feedback loop associated with prior art FIG. 10 which uses a conventional bandgap's PTAT amplifier (that is vulnerable to transients) is eliminated in bandgap circuit of FIG. 7. This is done without denting bandgap's accuracy since the overall bandgap's operating current is compensated by topology with $ID_{M802}$ and $ID_{M824}$ tracking each other (also because of combining $I_{BIAS}$ generator of FIG. 8, the active MOS resistor of FIG. 9, and bandgap circuit of FIG. 7). Although other variations are possible depending on different performance trade-offs, note that for the embodiment of FIG. 7, PMOS transistors are used in all of bandgap's key signal paths (i.e., amplifiers, composite MOS resistor, etc.) which should enhance the topology for manufacturability, provide some immunity against SOC's substrate (digital) jitters, and be less (1/f) noisy. Note that in FIGS. 3, 7, 8, and 9 the scale factors 'a' through are the ratios of transistor's width over length (W/L or scale factors or aspect ratios) that may be set depending on such considerations as die size and various operating specifications, including but not limited to current consumption, temperature coefficients, and power supply range objectives. As such, for FIGS. 3, 7, 8, and 9 the scale factors 'a' through 'r' can be predetermined or programmed to be between approximately 0.1 to approximately 50. Similar to the bias current generators utilized in FIGS. 1, 2, and 3, the embodiment in FIG. 7 also employs a bias current generator, which is depicted in FIG. 3.

The connections of the elements in the embodiment of FIG. 8 are described as follows: node 1 is the positive supply voltage terminal or $V_{00}$. Node 2 is the negative supply voltage terminal or $V_{SS}$ (which can also be set as the zero voltage terminal or ground). Source and body of $M_{802}$, $M_{822}$, and $M_{820}$ are connected to node 1. Source and body of $M_{810}$, $M_{812}$, $M_{814}$, $M_{816}$, and $M_{818}$ are connected to node 2. Transistors $M_{800}$ and $M_{802}$ form the self cascode, where the diode connected $M_{800}$ is cascoded with $M_{802}$. Node 800 is connected to gate and drain f $M_{800}$, gate of $M_{802}$, and drain of $M_{810}$. Node 802 is connected to source and body of $M_{800}$, drain of $M_{802}$, drain of $M_{812}$, drain of $M_{822}$, and source and body of $M_{804}$. Note that the body terminal of $M_{800}$ can be connected to either its source at node 802 or to node 1, depending on performance objectives and the process fabrication. Moreover, here the PTAT Voltage is generated by using two DC level shifters (diode connected $V_{GS}$ followers) with a build in offset voltage, which is formed by diode connected MOSFETs $M_{804}$ and $M_{806}$ combined with current sources supplied by $M_{822}$, $M_{814}$ and $M_{216}$. Node 804 is connected to gate and drain of $M_{804}$, drain of $M_{814}$, and inverting input of amplifier $A_{800}$. Node 806 is connected to the non-inverting input of $A_{800}$, drain of $M_{816}$, and gate and drain of $M_{806}$. Node 808 is connected to the gates of $M_{810}$, $M_{812}$, $M_{814}$, $M_{816}$, and $M_{818}$. Node 810 is connected to the drain of $M_{818}$, and gate and drain of $M_{820}$. Note that $M_{820}$ and $M_{822}$, and $M_{810}$, $M_{812}$, $M_{814}$, $M_{816}$ and $M_{818}$ function as current mirrors, as well as VCCS whose gate voltage varies by the output of $A_{800}$. The drain current or $I_D$ of $M_{810}$ or that of $M_{818}$ constitutes the bias current of the circuit or reference current, $I_{BIAS}$.

The connections of the elements in FIG. 9 are described as follows: node 1 is the positive supply voltage terminal or $V_{DD}$. Node 2 is the negative supply voltage terminal or $V_{SS}$ (which can also be set as the zero voltage terminal or ground). Source and body of $M_{824i}$ are connected to node 1. Drain of $M_{824b}$ is connected to node 2. Node 826 is connected to drain of $M_{824i}$, body and source of $M_{824b}$, and the inverting input of $A_{824}$. $M_{824i}$ functions as the current source whose current is mirrored from (VBISA) node 810 to establish the operating current for $M_{824b}$. Node 824 is connected to gate of $M_{824b}$ and the output of $A_{824}$. Node 822 is connected to non-inverting node of $A_{824}$ and drain of $M_{824r}$. Node 820 is connected to source ad body of $M_{824r}$. Single, series or parallel combinations of $M_{824r}$ can be as the resistor cell that is used in the bandgap (e.g., R800 and R802 of FIG. 10).

The connections of the elements in FIG. 7 are described as follows: node 1 is the positive supply voltage terminal or $V_{DD}$. Node 2 is the negative supply voltage terminal or $V_{SS}$ (which can also be set as the zero voltage terminal or ground). Source and body of $M_{836i}$, $M_{834i}$, $M_{832i}$, $M_{830i}$, $M_{828i}$, and $M_{826i}$ are connected to node 1. Node 2 is connected to drains of $M_{834b}$, $M_{832b}$, $M_{830b}$, $M_{828b}$, and $M_{826b}$ as well as collectors of $Q_{806}$ and $Q_{804}$. Node 3 is $V_{MID}$, which can also be connected to the ground or zero potential, and is connected to the base of $Q_{804}$ and $Q_{806}$. Node 828 is connected to emitter of $Q_{804}$, positive input of $A_{836}$, and drain of $M_{836}$. Node 830 is connected to emitter of $Q_{806}$, positive input of $A_{826}$, and drain of $M_{826r}$. Node 832 is connected to gates of $M_{826r}$ and $M_{826b}$ and output of $A_{826}$. Node 834 is connected to source and body of $M_{826b}$, drain of $M_{826i}$, and negative input of $A_{826}$. Node 836 is connected to the source and body of $M_{826r}$, positive input of $A_{828}$, drain of $M_{828r}$, and negative input of $A_{836}$. Node 838 is connected to gates of $M_{828r}$ and $M_{828b}$ and output of $A_{828}$. Node 840 is connected to source and body of $M_{828b}$, drain of $M_{828i}$, and negative input of $A_{828}$. Node 842 is connected to the source and body of $M_{828i}$, positive input of $A_{830}$, drain of $M_{830r}$. Node 844 is connected to gates of $M_{830r}$ and $M_{830b}$ and output of $A_{830}$. Node 846 is connected to source and body of $M_{830b}$, drain of $M_{830i}$, and negative input of $A_{830}$. Node 848 is connected to the source and body of $M_{830r}$, positive input of $A_{832}$, drain of $M_{832r}$. Node 850 is connected to gates of $M_{832r}$ and $M_{832b}$ and output of $A_{832}$. Node 852 is connected to source and body of $M_{832b}$, drain of $M_{832i}$, and negative input of $A_{832}$. Node 854 is connected to the source and body of $M_{832r}$, positive input of $A_{834}$, drain of $M_{834r}$. Node 856 is connected to gates of $M_{834r}$ and $M_{834b}$ and output of $A_{834}$. Node 858 is connected to source and body of $M_{834b}$, drain of $M_{834i}$, and negative input of $A_{834}$. Node 860 is the $V_{REF}$ of $V_{BG}$ connected to body and source of $M_{834r}$, and output of $A_{836}$.

The connections of the elements in the prior art FIG. 10 are described as follows: node 1 is the positive supply voltage terminal or $V_{DD}$. Node 0 is the ground or zero voltage terminal. Node 1 is connected to body and source of $M_{800a}$ and $M_{802a}$ as well as output of $A_{802}$. Node 0 or ground is connected to base and collector of $Q_{800}$ and $Q_{802}$. Node 804*a* is connected to emitter of $Q_{802}$ and one side of $R_{800}$. Node 802*a* is connected to the other side of $R_{800}$ and one side of $R_{802}$ and the positive input of $A_{802}$. Node 808*a* is the $V_{REF}$ or $V_{BG}$ output that is connected to the other side of $R_{802}$ and the drain of $M_{820a}$. Node 806*a* is connected to the gates of $M_{802a}$ and $M_{800a}$ and the output of $A_{802}$. Node 800*a* is connected to emitter of $Q_{800}$, drain of $M_{800a}$, and negative input of $A_{802}$.

As noted earlier, the proposed circuit belongs to the general category of bandgap voltage references in standard digital CMOS that operate in subthreshold (see FIG. 7). One part of the proposed bandgap is the $I_{BIAS}$ generation circuit that is shown in simplified FIG. 8 (which is the embodiment of the functional block diagram of bias current generation shown in FIG. 3, which is also a variation of the functional block diagrams of the bias current generation embodiments shown in FIG. 1 and FIG. 2).

In FIG. 8 there is the first voltage loop consisting of $M_{802}$, $M_{804}$, $A_{800}$, and $M_{806}$ produce a PTAT signal as a function of $V_T$, which is forced upon the $V_{DS}$ of $M_{802}$ by the operation of the loop. There is also a second voltage loop consisting of $M_{800}$ and $M_{802}$ where $M_{800}$ operates in saturation and $M_{802}$ operates in the triode region (i.e., that is acting as an active resistor of $R_{M802}=R_{BIAS}$ for this current source). The active resistor, while functioning as the current source's resistor, contributes to a CTAT signal being mostly a function of μ. Application of PTAT signal via VT while interacting with CTAT signal via μ whose combination (using different MOSFET aspect ratios) can facilitate making a positive TC, or negative TC, as well as a stable one for some temperature compensation for the $I_{BIAS}$. Note that for demonstrative clarity of the proceeding formulations, second order effects—including but not limited to—early voltage, body effect, subthreshold slope factor TC are ignored:

$$VGS_{M802}-VGS_{M800}=VDS_{M802};$$

$$R_{BIAS}=R_{M802}\approx[\mu.C_{OX}.(W/L)_{M802}(VGS_{M802}-V_{TH}-VDS_{M802}/2)]^{-1};$$

$$VGS_{M802}\approx[2I_{BIAS}/\mu.C_{OX}.(W/L)_{M800}]^{1/2}+V_{TH};$$

$$VGS_{M806}-VGS_{M804}=[V_T.\ln(d\times b)]=VDS_{M802};$$

$$VDS_{M802}\approx I_{BIAS}(e+1)\times R_{M802}[V_T.\ln(cxb)];$$

$$\mu.C_{OX}.(W/L)_{M202}\times[I_{BIAS}/\mu.C_{OX}.(W/L)_{M200}]^{1/2}\approx I_{BIAS}(e+1)\times[V_T.\ln(cxb)]^{-1};$$

$$I_{BIAS}\approx f(S_{800},\mu,V_T).$$

This $I_{BIAS}$, mostly a function of $S_{800}$ (which is formulaic representation consisting of MOSFET W/L ratios and MOSFET's device constants) as well as μ, and $V_T$.

The composite active MOS resistor of FIG. 9 is formed via the loop composed of $A_{824}$, $M_{824b}$ (saturation mode), and $M_{824r}$ (in linear mode). In FIG. 9, $M_{824r}$ replaces and performs the role of bandgap resistor, $R_{BG}$ in FIG. 10.

The equivalent of $R_{BG}$ of FIG. 10 is the composite active MOS resistor $R_{M826r}$, which is utilized in the PTAT loop composed of $Q_{806}$, $Q_{804}$, and $A_{836}$ shown in the bandgap circuit of FIG. 7. Ignoring non-idealities (e.g., $V_{OFS}$) for now, the concurrent operation of the active MOS resistor composed of $A_{826}$-$M_{826r}$-$M_{826b}$ voltage loop (depicted in FIG. 7) which is utilized in the bandgap in combination with the $Q_{806}$-$Q_{804}$-$A_{836}$ voltage loop roughly yields:

$$VDS_{M826r}\sim V_T.\ln(n_1\times g);$$

$$VGS_{826b}-VGS_{826r}\sim VDS_{826r}\sim V_T.\ln(n_1\times g);$$

$$IDS_{M826r}\sim V_T.\ln(n_1\times g)/R_{M826r};$$

$$IDS_{M826r}\sim IDS_{M826b}\sim f(S,\mu,V_T).$$

As such, $IDS_{M826r}$ (and the composite MOS's resistance) is mostly a function of $V_T$ and μ and is independent of MOSFET's $V_{TH}$. Here, the dependence of $R_{BG}$'s network (of active resistance and its operating current) on μ and $V_T$ and their approximate independence from $V_{TH}$ can help enhance manufacturability and enable performance optimization, including efficient trimming to attain higher accuracy in this bandgap. To simplify description of this circuit's operations and it benefits, the composite active MOS resistors are approximated as: $R_{BG}$ as a lump sum 'resistor' in series with a lump sum 'voltage source' (which encapsulates the offset mismatch due to $V_{GS}$ terms of MOSFETs as well as the amplifier in the composite active resistor circuit of FIG. 9). In such a model the 'voltage source' is an offset voltage ($V_{OFSR}$) between the composite active MOS resistors in the bandgap PTAT loop. Note that the $V_{OFSR}$ the systematic offsets are cancelled out: $R_{802}/R_{800}\sim(R_{M828r}+R_{M830R}+R_{M832r}R_{M834r})/R_{M826r}$.

$\Delta V_{OFSR}$ is configured as the random mismatch between $VOFS_{M828r}$, $VOFS_{M830r}$, $VOFS_{M832r}$, $VOFS_{M834r}$, $VOFS_{M826r}$ of each of the composite MOS resistors. Here $\Delta V_{OFSR}$ should induce an additional offset error term (statistical contribution) to $V_{BG}$ output of roughly $(G+1)^{1/2}\times\Delta V_{OFSR}$ where 'G' is set by the (number active MOS resistor in series in the feedback loop of the bandgap circuit) ratio of string of composite active MOS resistors in the PTAT loop to satisfy the functional equivalent $R_{802}/R_{800}$ ratio (in FIG. 10) requirement for a near zero TC $V_{BG}$. Given that MOSFETs operate in subthreshold, $V_{TH}$ mismatches dominate the differential pairs (i.e., input amplifiers, etc.) offset terms, and $\Delta V_{OFSR}\sim f(V_T)$ that tracks the PTAT term in $V_{BG}$ and can be roughly trimmed out for more precision.

To guard band for start-up and transient response $A_{836}$'S output does not drive both the operating currents that feed $Q_{804}$ and $Q_{806}$ in order to eliminate the positive feedback in the PTAT loop. But accuracy of the $V_{BG}$ is not compromise. This is because the proposed embodiment of FIG. 7 enables $I_{BIAS}$, which feeds $Q_{804}$ and the strings of composite MOS resistors with the bandgap's PTAT loop that operate in a substantially (formulaically) similar manner, tracking each other over fabrication process, and temperature variations. Moreover, the same single pole CMOS amplifier is utilized throughout the bandgap which offers better transient, AC, and PSRR performance. Excluding the impact of random mismatch between amplifier offsets, the systematic higher $V_{OFSA}$, which is the offset voltage associated with single pole amplifiers ($A_{836}$), is roughly canceled out, and hence approximately: $V_{BG}$~$V_{EB}$+(G+1)[$V_T$.ln($n_1$×g)+$V_{OFSA}$]+(G+1)$^{1/2}$.$\Delta V_{OFSR}$.

Although other variations of this topology are possible, the embodiment in FIG. 7 utilizes (but for substrate vertical PNPs in the PTAT section of the bandgap) PMOSFETs in the key signal paths (i.e., MOS resistors, bandgap amplifier, composite resistor amplifier, bias circuit MOS resistors and amplifier) that dictate bandgaps DC, AC, and transient performance. This use should further enhance manufacturability since most of the bandgap's performance would depend on fewer device parameters. This move should also improve the AC response of the bandgap, better 1/f noise performance, as well as provide some immunity against transient substrate noise when the bandgap is in a noisy SOC.

In summary the benefits of the embodiment in FIG. 7 are as follows. First, this is a voltage reference is based in standard digital CMOS fabrication. References are considered a key and critical electronics functions needed around actuators, sensors, and other access points circuits (for energy harvesting and wireless and batteryless Internet of things applications) must be small, low cost, and manufacturable to make it to high volume. As such, main stream digital CMOS processes can produce the smallest and be the lowest cost manufacturing platforms, assuming that circuit solutions here neither require any additional steps (i.e., no separate n-wells and p-wells or depletion mode MOSFETs) nor impose any non-standard device configuration (i.e., no lateral PNP, DMOST, or MOS body). Second, this is an ultra low power bandgap reference that could only require for example under approximately 250 nano ampere of current. Energy harvesting, wearable and next generation implantable bio-medical electronics are but a few examples of emerging wire-less-battery-less (WLBL) Internet of Things (IoT) applications with large total available market (TAM) potentials that require such ultra-low power and very small form-factor solutions. A voltage or current reference is a fundamental building block in systems, including in WLBL electronics that for example have to monitor, measure report on referenced levels of carbon monoxide, toxicity, acidity, sugar or salt levels, blood pressure, temperature, or a heart pulse, just to name a few.

As noted above, for WLBL electronics market potential to materialize, it is imperative that circuits ought to operate with ultra low currents. Hence the use of passive resistors are nonviable for several reasons: higher resistance obviously means prohibitively large die area (e.g., $V_{PTAT}$ of 700 mV at 10 nA requires 70MΩ poly resistor). Mainstream digital CMOS foundries generally do not guarantee resistance specifications, including for higher Ω/square poly resistors. Compared to lower Ω/square layer 1 poly resistors, the layer 2 higher Ω/square ones typically exhibit higher mismatch, worst non-linearity, and inferior TCs, in part because of less fabrication process control for the less critical process layers (i.e., ploy 2 and higher layers, especially highly doped ones). High Ω/square diffusion resistors are also impractical here due to unfavorable leakage, VC, and TC characteristics. Therefore, predominant research on ultra low power configurations, based on digital standard CMOS, has produced (non-conventional) non-bandgap topologies to generate voltage references, that are generally not as rugged as bandgaps.

In order to guard band for long-term production continuity, utilizing the kind of circuit topologies that can be ported to multiple process nodes with minimal challenge are obviously favored. In this regards, conventional bandgap topologies could generally be viewed on a more positive light because of manufacturing's familiarity and experience with the more predictable and controllable BJT parameters such as $V_{BE}$ and $V_T$ that constitute $V_{BG}$. This embodiment retains the benefit of the class of bandgap voltage references to which it belongs.

This embodiment provides a composite active CMOS resistor (FIG. 9) that is small in size, consumes ultra low power (eliminates the need for passive resistors), and works in combination with the $I_{BIAS}$ generator (FIG. 8 which is the embodiment of the functional block diagram of FIG. 3), and in combination with bandgap circuit (FIG. 7) in such a way that the active MOS resistors' and $I_{BIAS}$ generator's and bandgap's circuits operating conditions track each other. As such more stable and reliable performance is achievable over process, temperature, and power supply variations. Given that the circuit current consumption is approximately in depended of MOSFET's $V_{TH}$, mainly a function of $V_T$ and μ, which are more tightly controllable, hence manufacturability and performance specification can be improved. Combination of the features of $I_{BIAS}$ circuit and active MOS circuit enables, segregating the positive and negative feedback loops of the bandgap circuit, without materially denting its DC performance. Instead, the AC and transient performance of this circuit is improved. For example, batteryless energy harvesting or IoT applications could receive their power from single type (e.g., single or series of solar diodes) or multiple energy harvester types (e.g., solar diodes in the light, and magnetic harvesters in the dark in conjunction with super capacitors to store voltage). The $V_{DD}$ power-on and power-off patterns may be jittery and not follow a predictable or orderly pattern, and hence the AC and transient response of the references are as critical as their DC accuracy. Feeding the output of PTAT loop amplifier via MOSFETs back to its positive and negative inputs are avoided in this topology because they can pose start-up and transient risks (inherent in typical bandgap reference topologies). Another benefit of the FIG. 7 embodiment is that $V_{SS}$ (negative power supply) and the ground potential (GND) may be the same of separated, providing flexibility to system embodiments. Also note that a challenge with ultra low current and MOSFETs is high noise. In FIG. 7, the bandgap reference's noise can be materially band pass filtered out by placing a capacitor in the end amplifier ($A_{834}$ that is used to form the composite active resistor) high impedance node of output amplifier but in accordance with consideration for power up and down settling time requirements. Additionally, PMOSFETs are used in the composite active resistors as well as in the output amplifier which should reduce the contribution of 1/f noise to the $V_{BG}$ output.

In summary, disclosed above are bias current topologies with embodiments in current source, current reference, (pseudo bandgap) voltage reference, and bandgap voltage reference that operate at ultra low currents and low power supply voltages which may use main stream standard digital Complementary Metal-Oxide-Semiconductor (CMOS) processes. The bias current topology uses chiefly a self cascode (SC) and PTAT offset generation with loop signal amplification to produce a bias current. The bias current circuit, senses and forces the PTAT signal (mostly as a function thermal voltage $V_T$) at the gates of its loop amplification circuit, which in combination with a CTAT signal (mostly as a function of mobility of MOSFETS, μ) provides the flexibility of setting a negative, positive, or stable temperature coefficient (TC) bias current generator circuit, depending on an application's need. This circuit retains the benefits of the class of bias current circuits, whose current variations are approximately independent of threshold voltage ($V_{TH}$) and mostly a function μ. Hence die yields and performance over process and temperature spans are improved. Embodiments of the bias current topology (FIG. 1) in a current source (FIG. 4) is provided which offers wider temperature span, in part, due to lower leakage associated with the bias current topology. Also bias current topology (FIG. 1) is utilized in the embodiment of a current references (FIG. 5) that combines multiple bias current source, with the capability of setting the current's TC and amplitude approximately independently from one another. This trait enables greater flexibility and making a higher performance and more stable current reference over process, temperature, and power supply variations. Moreover, the bias current topology when combined with series of SCs (FIG. 6) that make a summation of pseudo $V_T$'s that can be added to a $V_{BE}$ of a parasitic BJT available in digital CMOS, to generate a pseudo bandgap voltage. Lastly, the bias current topology when combined with a composite active MOS resistor enables making a conventional bandgap reference. A PTAT voltage is applied across the active MOS resistor, which is gained up using the strong of the same active MOS resistor to generate the required $V_{PTAT}$ that is added to $V_{BE}$ of parasitic BJT in digital CMOS to generate the $V_{BG}$. The bias generation, active MOS resistor, and bandgap circuits use substantially similar functionality, which enables their operating conditions to track and hence enhancing their performance of the bandgap over process, temperature, and power supply variations. Moreover, the topology not only delivers ultra low power but also one whose current consumption is approximately independent of $V_{TH}$, which can improve performance and die yield. All such embodiments enable making ultra low power, low cost (base on standard digital CMOS fabrication that are portable across multiple fabrications), with optimized yields (due in part to independence from $V_{TH}$).

A number of embodiments are described in the present application, and are presented for illustrative purposes only. The described embodiments are not, and are not intended to be, limiting in any sense. One of ordinary skill in the art will recognize that the disclosed embodiment(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Recitation of ranges of values herein are merely intended to serve as a shorthand method of referring individually to each separate value falling within the range, unless otherwise indicated herein, and each separate value is incorporated into the specification as if it were individually recited herein. Therefore, any given numerical range shall include whole and fractions of numbers within the range. For example, the range "1 to 10" shall be interpreted to specifically include whole numbers between 1 and 10 (e.g., 1, 2, 3, . . . 9) and non-whole numbers (e.g., 1.1, 1.2, . . . 1.9).

The present disclosure is not a literal description of all embodiments of the invention(s). Also, the present disclosure is not a listing of features of the invention(s) which must be present in all embodiments. A description of an embodiment with several components or features does not imply that all or even any of such components/features are required. On the contrary, a variety of optional components are described to illustrate the wide variety of possible embodiments of the present invention(s).

Although process (or method) steps may be described or claimed in a particular sequential order, such processes may be configured to work in different orders. In other words, any sequence or order of steps that may be explicitly described or claimed does not necessarily indicate a requirement that the steps be performed in that order. The steps of processes described herein may be performed in any order possible. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention(s), and does not imply that the illustrated process is preferred. Although a process may be described as including a plurality of steps, that does not imply that all or any of the steps are preferred, essential or required. Various other embodiments within the scope of the described invention(s) include other processes that omit some or all of the described steps.

Although a product or system may be described as including a plurality of components, aspects, steps, qualities, characteristics and/or features, that does not indicate that any or all of the plurality are preferred, essential or required. Various other embodiments within the scope of the described invention(s) include other products that omit some or all of the described plurality.

The invention claimed is:

1. A method of generating a bias current in an integrated circuit, the method comprising:

generating a proportional-to-absolute temperature voltage (VPTAT);

providing an active resistor metal-oxide-semiconductor field effect transistor (RA MOSFET);

applying the VPTAT across the RA MOSFET to generate a bias current (IB);

scaling the IB to generate a first scaled IB and a second scaled IB;

utilizing a self-cascode circuit comprising a diode connected MOSFET (DC MOSFET) coupled with the RA MOSFET;

providing the first scaled IB to the DC MOSFET and providing the second scaled IB to the RA MOSFET;

wherein the DC MOSFET includes a first gate terminal, a first drain terminal, and a first source terminal;

wherein the RA MOSFET comprises a second gate terminal, a second drain terminal, and a second source terminal;

wherein the first gate terminal and first drain terminal of the DC MOSFET are coupled with the second gate terminal of the RA MOSFET; and wherein the first source terminal of the DC MOSFET is coupled with the second drain terminal of the RA MOSFET.

2. A method of using composite active resistors (RACs) made of metal-oxide semiconductor field effect transistors (MOSFET) in a bandgap voltage reference (VBG) comprising:

operating a first resistor, comprised of a plurality of RAC1s, in a proportional to absolute voltage (VPTAT) loop to generate a PTAT current (IPTAT);

flowing the IPTAT through a second resistor, comprised of a plurality of RAC2s, wherein a gain (K) factor that is the ratio of K=RAC2/RAC1;

generating a complementary to absolute temperature (CTAT) voltage (VCTAT)

wherein VBG=VCTAT+K.VPTAT from the base emitter voltage (VBE) of a bipolar junction transistor (BJT); and wherein the normal manufacturing variations in RAC1 and RAC2 track each other and approximately cancel out in their ratio K=RAC2/RAC1 which generates a stable gain factor (K) with a VBG that is less sensitive to normal manufacturing variation of RAC1 and RAC2.

* * * * *